US005182977A

United States Patent [19]

Gulbrantson

[11] Patent Number: 5,182,977

[45] Date of Patent: Feb. 2, 1993

[54] HYDRAULIC CENTRIFUGAL PISTON MOTOR

[76] Inventor: William Gulbrantson, 3153 Kilkenny Dr., Riverside, Calif. 92503-5315

[21] Appl. No.: 761,174

[22] Filed: Sep. 12, 1991

[51] Int. Cl.[5] ..... F01B 13/04

[52] U.S. Cl. ..... 91/197; 91/491; 92/56

[58] Field of Search ..... 91/491, 197; 92/56, 92/68, 72; 60/536

[56] References Cited

U.S. PATENT DOCUMENTS

| | | | |
|---|---|---|---|
| 2,417,894 | 3/1947 | Wayland | 92/68 |
| 2,427,570 | 9/1947 | Niemann | 92/68 |
| 3,287,909 | 11/1966 | Kell | 60/536 |
| 3,915,064 | 10/1975 | Dancs | 92/68 |
| 3,974,801 | 8/1976 | Brown | 92/56 |
| 4,058,088 | 11/1977 | Brown | 92/56 |
| 4,166,438 | 9/1979 | Gottschalk | 91/197 |
| 5,049,039 | 9/1991 | Knoth et al. | 92/68 |

*Primary Examiner*—Richard A. Bertsch
*Assistant Examiner*—Peter Korytnyk

[57] ABSTRACT

An hydraulic centrifugal piston motor having mulitple piston circumferentially disposed at right angle to shaft axis, having a rotational power moment that occurs twice each revolution for each cylinder. The power stroke for each cylinder would occur for a duration of 90 degrees twice during each 360 degree operating cycle. Hydraulic input is applied to opposing pairs of cylinders and overlap of successive power strokes provide rotational balance and cancels net reaction forces applied to the bearings. Another feature of the motor would be the particular design of the power transfer device. The thrust of the power transfer device is applied axially to the drive shaft providing a smooth transfer between the hydraulic input power and the mechanical output power.

5 Claims; 28 Drawing Sheets

35

32

37B
35A
37B
33F
30A
32A
31A
22C
22C
38
38

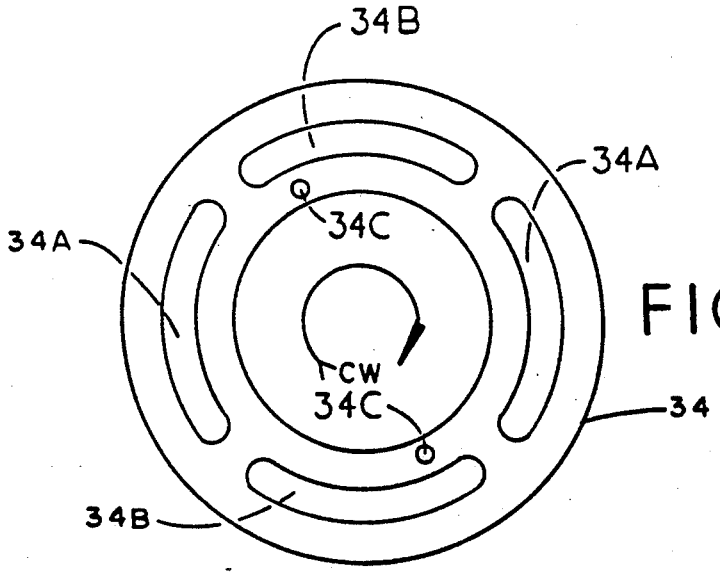
FIG. 3G
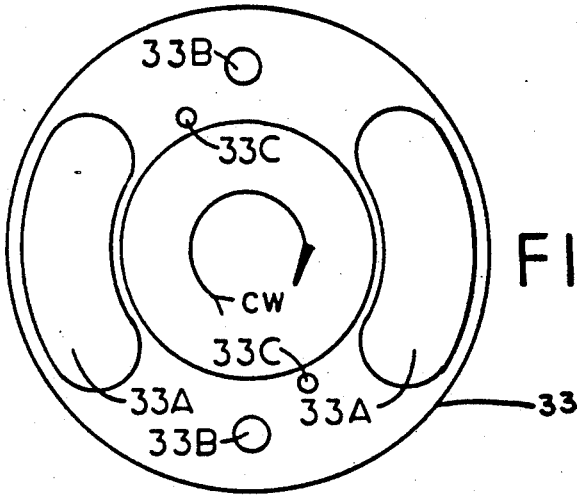
FIG. 3F
FIG. 3H
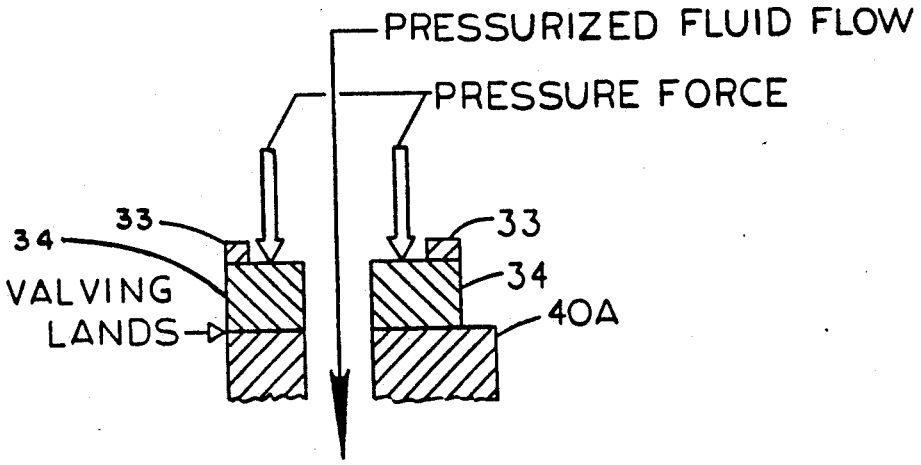

HYDRAULIC CENTRIFUGAL PISTON MOTOR

BACKGROUND OF INVENTION

This invention relates to a highly efficient to mechanical power transfer device.

In demanding applications of industrial processes and manufacturing of machinery and power transmission equipment hydraulic motors provide the most compact powerful high torque low speed means of producing mechanical power available. Mechanical efficiency and volumetric efficiency are highly important factors in these processes.

This invention provides a useful and original means of producing high mechanical efficiency and high volumetric efficiency by utilizing a new and innovative development in producing high output mechanical torque at an extremely high efficiency in relation to the horsepower to be transmitted at various speeds of rotation.

The simplicity, and freedom from complexity of the completely assembled Hydraulic Centrifugal Piston Motor enhances reliability, decreases cost of manufacturing, decreases weight, and facilitates salability to a manufacturer and to the public.

FIELD OF INVENTION

Accordingly, it is an object of the invention to provide a new and useful hydraulic piston motor producing high output mechanical torque with high volumetric efficiency throughout the operational speed ranges of the motor.

It is also an object of the invention to provide a hydraulic piston motor that has no gears or similar devices.

A further object of the invention is to provide a hydraulic motor comprised of two rotating unidirectional assemblages, operating in synchronous constant velocity, producing high output torque to a drive shaft axis during operations.

Another object of the invention is to provide diametrically opposing input and output flow of hydraulic fluid to improve balanced rotational motion throughout the 360 degree constant input flow. The volume of the steady input flow is a factor which limits maximum rotational speed.

Yet another object of the invention is to provide a six cylinder hydraulic piston motor having a rotational power moment that would occur twelve times per revolution, the power stroke from each cylinder would occur twice each revolution for a duration of 90 arc degrees during each complete 360 degree operating cycle. For one cylinder operation during the 360 degree rotation of the cylinder block, the first quadrant produces a power stroke, the cylinder exhausts during the second quadrant, the third quadrant produces a power stroke from the same cylinder, cylinder exhaust reoccurs during the fourth quadrant. The same progression applies to subsequent and preceding cylinders during operation.

Likewise, it is an object of the invention to provide for varied size hydraulic motor requirements, the number and size of the power cylinders, and the piston rod support ring radius distance, may be increased or decreased, to meet output torque requirements at high efficiency operation.

A further object of the invention is to provide an annular cylinder block of rigidly fixed uniformity, to be mounted rearward on the drive shaft with its rotating centerline axis perpendicular to the horizontal drive shaft axis, having power cylinder locations circumferentially located on outer boundary of cylinder block facing outward in a straight line secantly to the circle, each cylinder assembly comprised of a cylinder, piston, and rod. Hydraulic fluid is supplied to and exhausted from each individual cylinder through its own fluid port, and a porting valve plate located at valving lands contact face at rear of cylinder block. The drive shaft assembly and the cylinder block assembly comprise one rotating assemblage.

It is also an object of the invention to provide an annular piston rod support ring of rigidly fixed uniformity, that would rotate about a fixed circumference in a spherical angle, concentric with cylinder block and drive shaft axis, to control and limit angularity of connecting rods with cylinder bores during operations. During the rotation of the cylinder block and the rod support ring, the rod support ring moves laterally from the centerline of the rotating cylinder block and returns twice during each revolution allowing the piston to ravel forward and return twice during each revolution.

Yet another object of the invention is to provide rod anchor locations on the rod support ring to be evenly spaced symmetrically, and concentric, with respect to the drive shaft axis at all times during operations, thus improving rotational balance and reducing bearing loads.

Still another object of the invention is to provide for overlap of successive piston power strokes applied to the rod support ring to produce constant torque output at low operating speeds, timing of piston power strokes between current and preceding piston power strokes would be at 60 degree intervals, this overlap of successive power strokes provides improved output torque, motor would have the capability of starting from zero under load situations with high torque efficiency, subsequently, motor could be applied directly in applications where added cost and friction of additional planetary or gear drives would otherwise be required.

A further object of the invention is to provide a drive shaft assembly, comprised of a single shaft assembly, comprised of a single shaft with a bore for mounting a torque actuator assembly. Torque actuator comprised of a thrust pin with ends diametrically protruding outward through shaft bore, with two truncated conically shaped bearing cups with needle bearings mounted on thrust pin protruding ends, and means for securing to drive shaft. Rear end of drive shaft is positioned in rear housing and mounted with a low-friction bearing, drive shaft output end protrudes from front housing and is mounted with anti-friction tapered roller bearings to carry radial and thrust loads simultaneously under load conditions.

Still another object of the invention is to provide a mechanically coupled means to transfer unidirectional force moments applied at rod support ring radius to produce mechanical output torque to the drive shaft axis. The mechanical output torque in pound-foot at the drive shaft axis is represented as a moment vector formed by the cross product of a force and a radius vector.

A further object of the invention is to provide an annular thrust yoke assembly, comprised of two similar halves forming a complement, each half having an arcuate mortise groove of 68 arc degrees, with its radius proportional to the thrust pin length, and grooved to accept the truncated conically shaped bearing cups of the torque actuator thrust pin, thus allowing universal coupling means between thrust yoke and drive shaft, synchronizing rotation with the thrust yoke, and drive shaft, to maintain a constant output torque at right angle to drive shaft axis at all times during the rotational operations.

Yet another object of the invention is to provide a thrust yoke positioner assembly, mounted on anti-friction ball bearings, to transfer the unidirectional force moments applied at rod support ring radius to the drive shaft, by connecting rod support ring and thrust yoke to the positioner assembly, thus comprising one unidirectioinal rotating assemblage.

A further object of the invention is to provide for anchoring the thrust yoke positioner assembly to the housing structure, thereby positioning the rod support ring spherical angle of rotation, thus controlling piston power strokes during the first and third quadrants, and piston exhaust strokes during the second and fourth quadrants, during operations.

Another object of the invention is to provide an annular fluid metering port valve plate, having four metering grooves of rectangular cross section, having two inlet ports, and two exhaust ports, diametrically opposed to the drive shaft axis, for valving of fluid into and out of the rotating cylinder block during operations.

A further object of the invention is to provide an encasement assembly of sufficient construction to allow mounting gears, pulleys, and sprockets, directly to output drive shaft.

It is also an object of the invention to provide a completely assembled hydraulic motor which is sufficiently simple in construction, whereas no new production technology is required for materials or manufacturing processes.

SUMMARY OF THE INVENTION

Briefly in accordance with the preferred form of the invention, a new and useful hydraulic piston motor is provided to maintain a high volumetric efficiency while also providing constant high torque output at low operating speeds, having only two rotating assemblages operating in synchronous constant velocity producing output torque to a drive shaft axis. The invention provides a smooth transfer between the hydraulic input power and the mechanical output power having no gears or similar devices. The piston power force applied to the rod anchor, and the distance from the rod support ring radius to the axis, determines the magnitude of the turning effect, torque, about that point, this applied turning effect would occur twelve times per revolution, each piston power stroke is maintained for ninety arc-degrees during the rotation, the pistons following in sequence begin their power strokes after the preceding piston has rotated sixty arc-degrees, thus maintaining an overlap of the applied forces to the turning effect during rotational operations, improving rotational balance and reducing bearing loads, hydraulic fluid would be applied to diametrically opposed pairs of cylinders. A universal mechanical coupling means is provided for synchronizing rotation of the two assemblages, thus synchronizing rotation of rod support ring, cylinder block, and drive shaft, maintaining constant output torque to drive shaft axis at all times during operations. Further objects, features, and the attending advantages of the present invention will be apparent when the following description is read in conjunction with the accompanying drawings.

BRIEF DESCRIPTION OF THE DRAWINGS

For a better understanding of the invention, together with other objects, advantages and capabilities thereof, reference is made to the following description of the accompanying drawings, in which:

FIG. 3F is a fluid port plate.

FIG. 3G is a port valve plate.

FIG. 3H is a diagrammatic of pressure loaded port valve plate.

DESCRIPTION OF PREFERRED EMBODIMENTS

Figure 1:
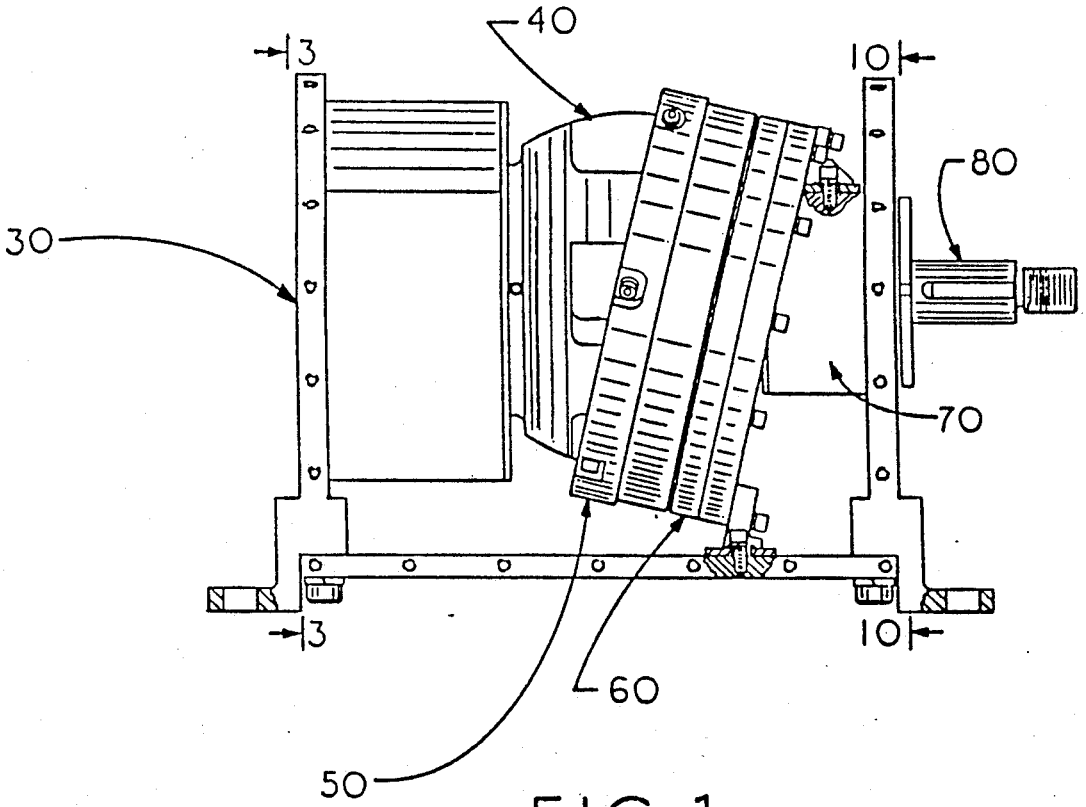
FIG. 1 is a side elevation of main assembly less cover.
Figure 1A:
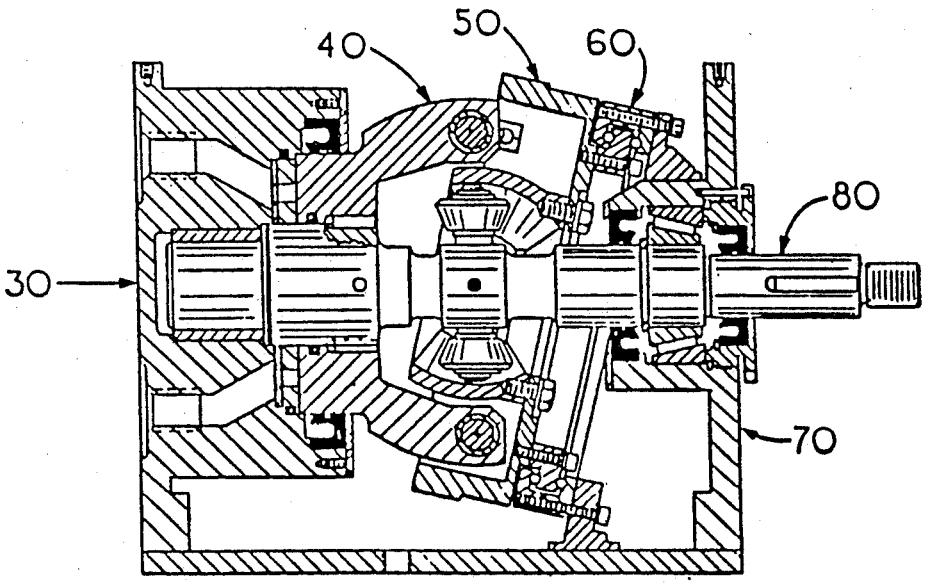
FIG. 1A is a vertical cross section of main assembly at center horizontal axis.
Figure 2:
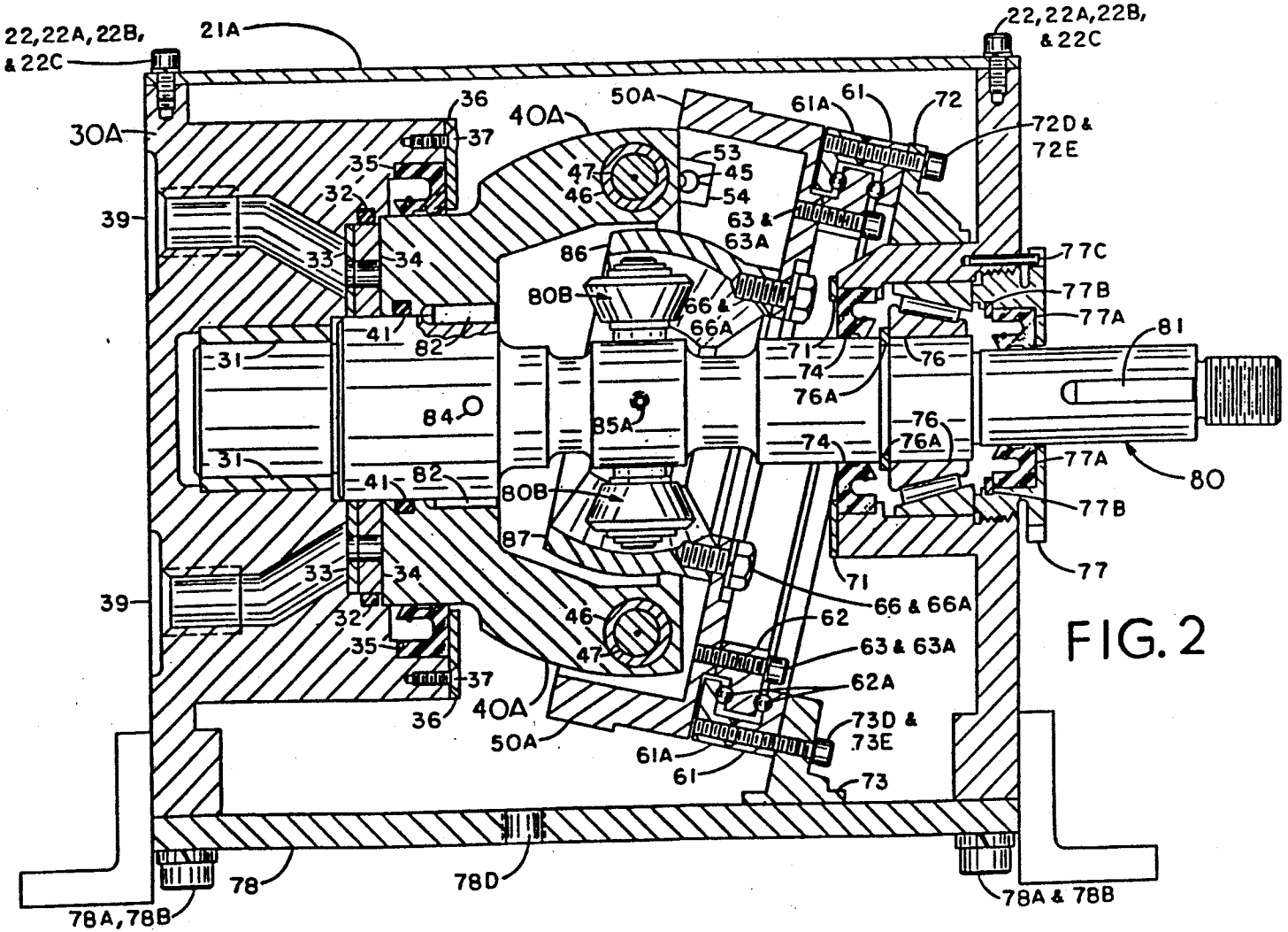
FIG. 2 is an enlarged vertical cross section of main assembly at center horizontal axis.

Referring to the drawings and particularly to FIG. 1, FIG. 1A, and FIG. 2, the invention shown in a specific arrangement as six subassemblies less cover. The construction material is all metal except for two O-rings and three oil seals.

Main assembly FIG. 1 includes rear housing assembly 30, cylinder block assembly 40, piston rod support ring assembly 50, thrust yoke positioner 60, front housing and base structure 70, and drive shaft assembly 80.

FIG. 1A shows a vertical cross section at horizontal axis of the six subassemblies 30, 40, 50, 60, 70, and 80. FIG. 2 is an enlarged vertical cross section at horizontal axis center showing interrelated parts and assemblies.

Figure 3:
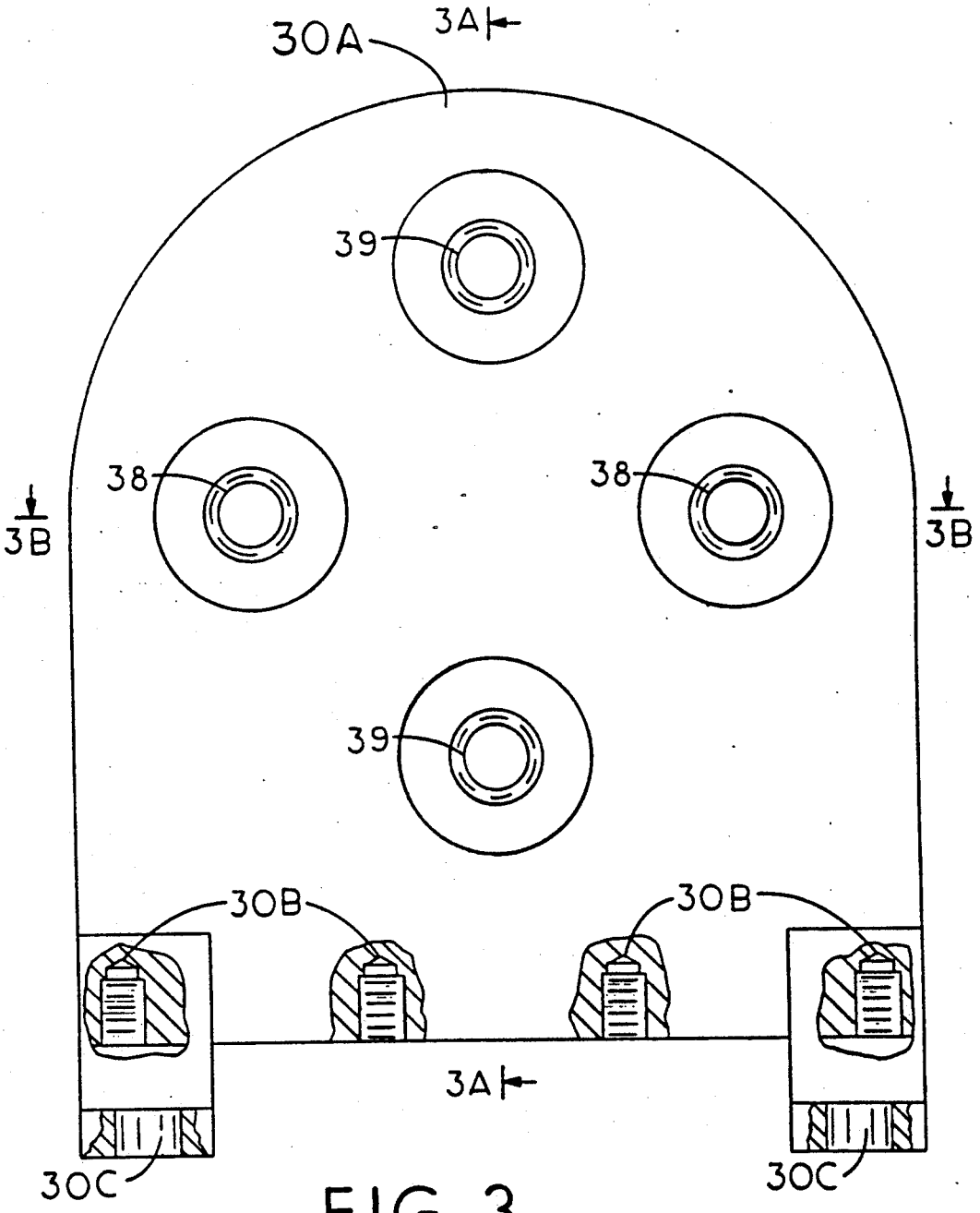
FIG. 3 is an elevation view of rear housing outside fluid port locations on line 3—3.

FIG. 3 shows outside elevation of rear housing 30A, threaded holes 30B, lugs 30C, fluid inlet ports 38, fluid exhaust ports 39. Fluid outside ports are threaded and have chamfer to accommodate an o-ring seat.

Figure 3A:
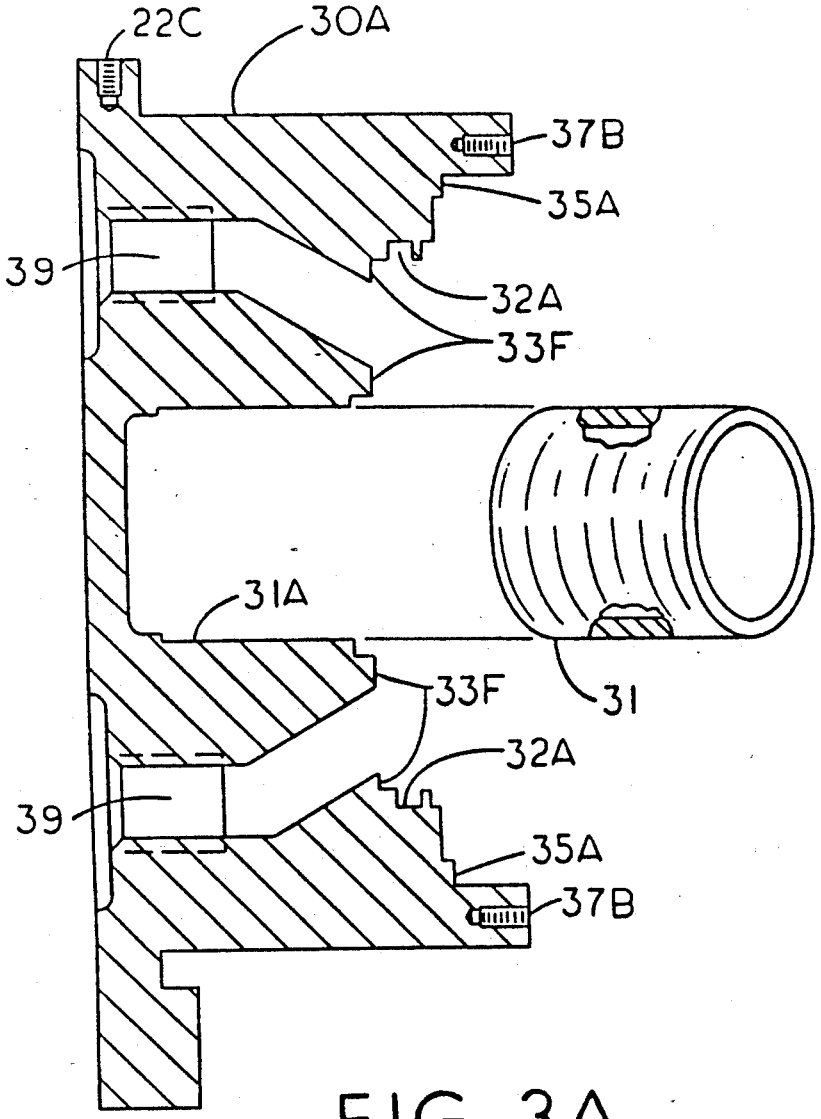
FIG. 3A is a vertical cross section of rear housing showing circular seating profile on line 3A—3A.

FIG. 3A shows vertical cross section profile of circular seating surfaces 31A, 32A, 33F, 35A, upper and lower exhaust ports 39, plain bearing 31, threaded hole 22C, and threaded holes 37B. FIG. 3B shows a horizontal cross section of circular seating surfaces 31A, 32A, 33F, 35A, left and inlet ports 38, threaded holes 22C, and threaded holes 37B.

Figure 3C:
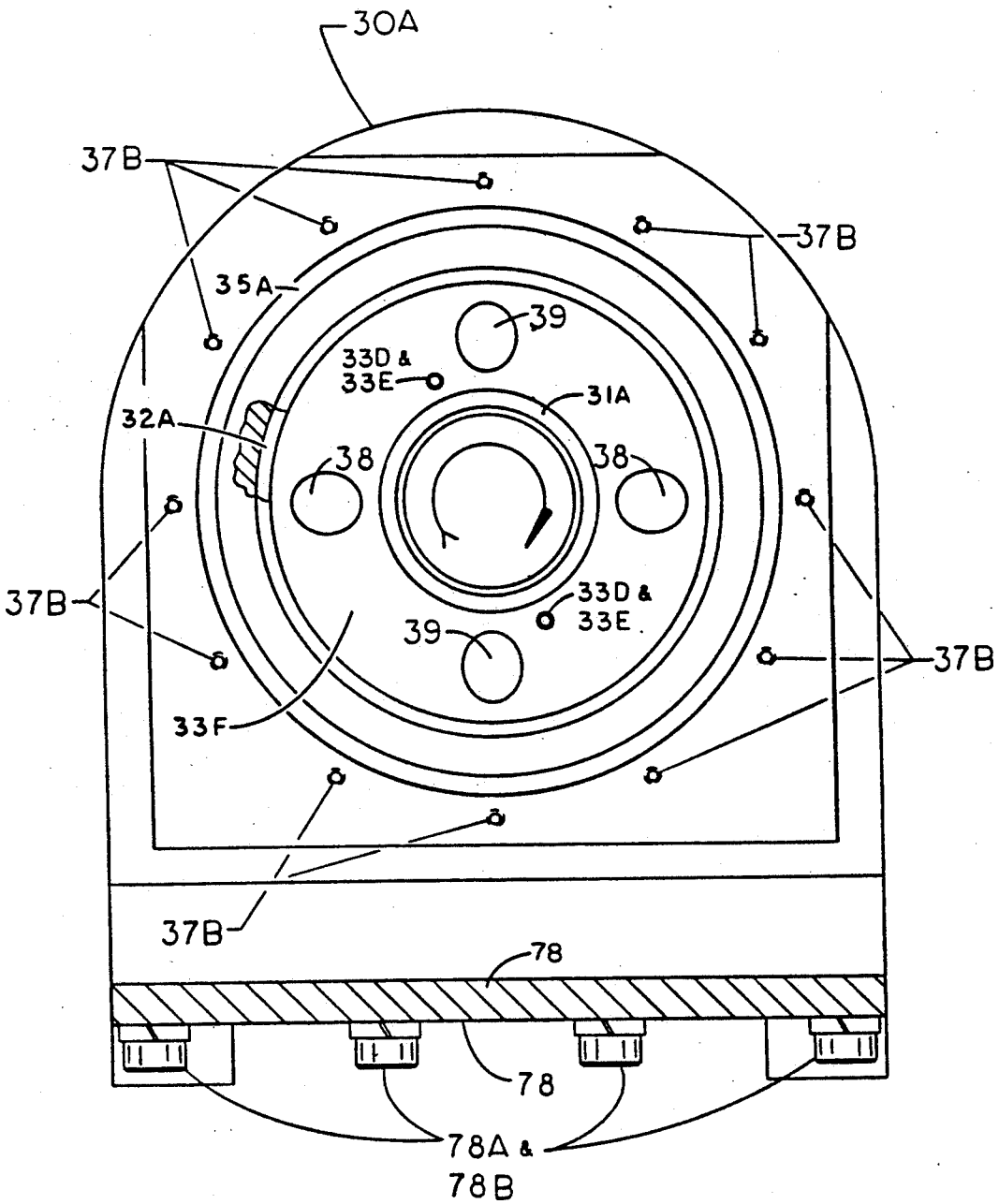
FIG. 3C is a vertical elevation inside view of rear housing circular seating and fluid ports.
Figures 3B, 3D, 3E:
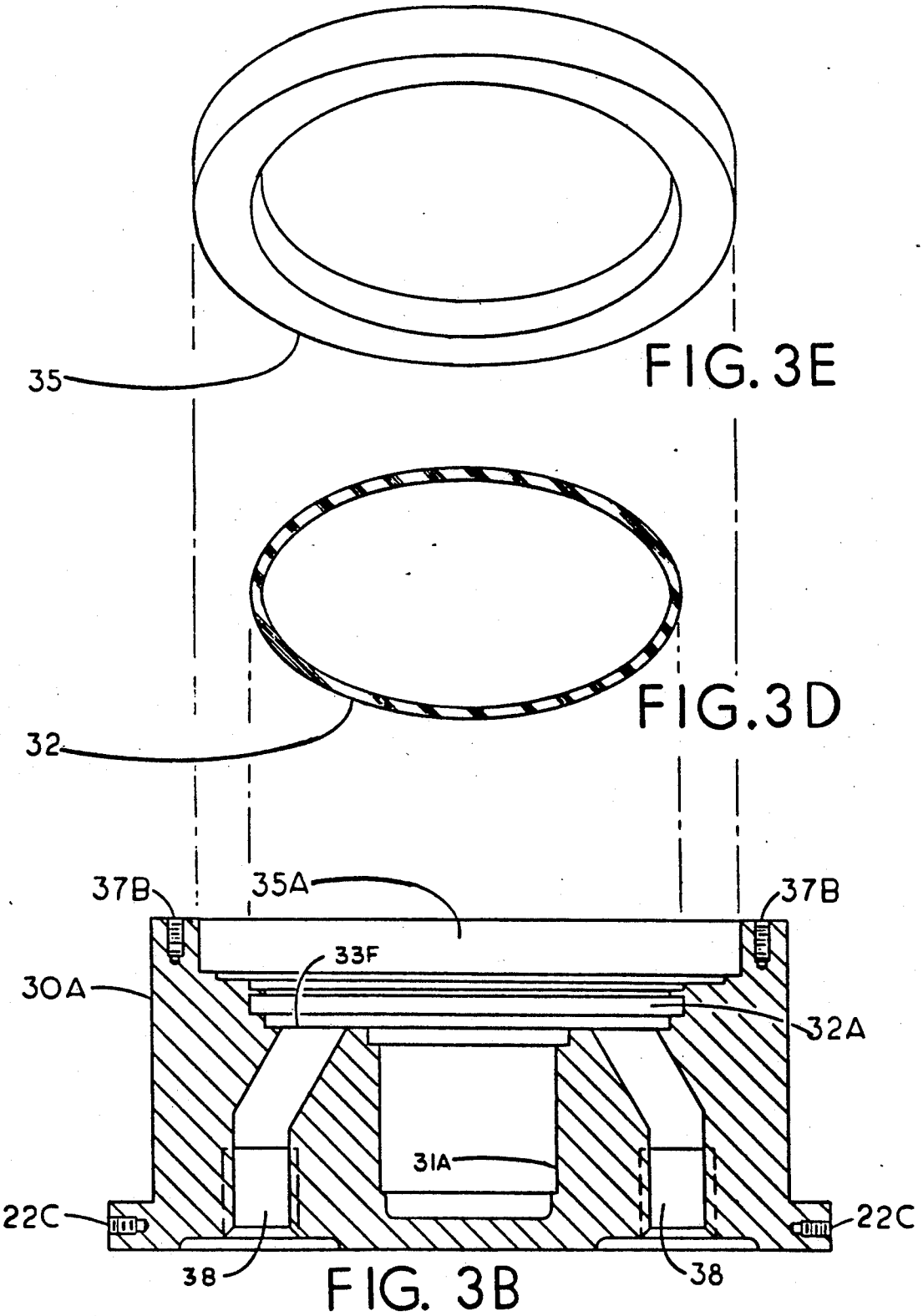
FIG. 3B is a horizontal cross section of rear housing circular seating and inlet ports on line 3B—3B.
FIG. 3D is a static O-ring seal.
FIG. 3E is a shaft type oil seal.

FIG. 3C shows inside elevation view of rear housing 30A attached to base plate 78 with bolts 78A and lock washers 78B, seat 31A, seat 32A, pins 33D, pin holes 33E, seat 33F, seat 35A, thread holes 37B, inlet ports 38, and exhaust ports 39. FIG. 3D is a static O-ring seal 32. FIG. 3E is an oil seal 35.

FIG. 3F shows port plate 33, inlet ports 33A, exhaust ports 33B and pin holes 33C. FIG. 3G shows port valve plate 34, inlet ports 34A, exhaust ports 34B, and pin holes 34C. FIG. 3H is a diagrammatic showing pressure loading of port valve plate 34 through port plate 33, and valving lands at rotating cylinder block 40A.

Figure 3J:
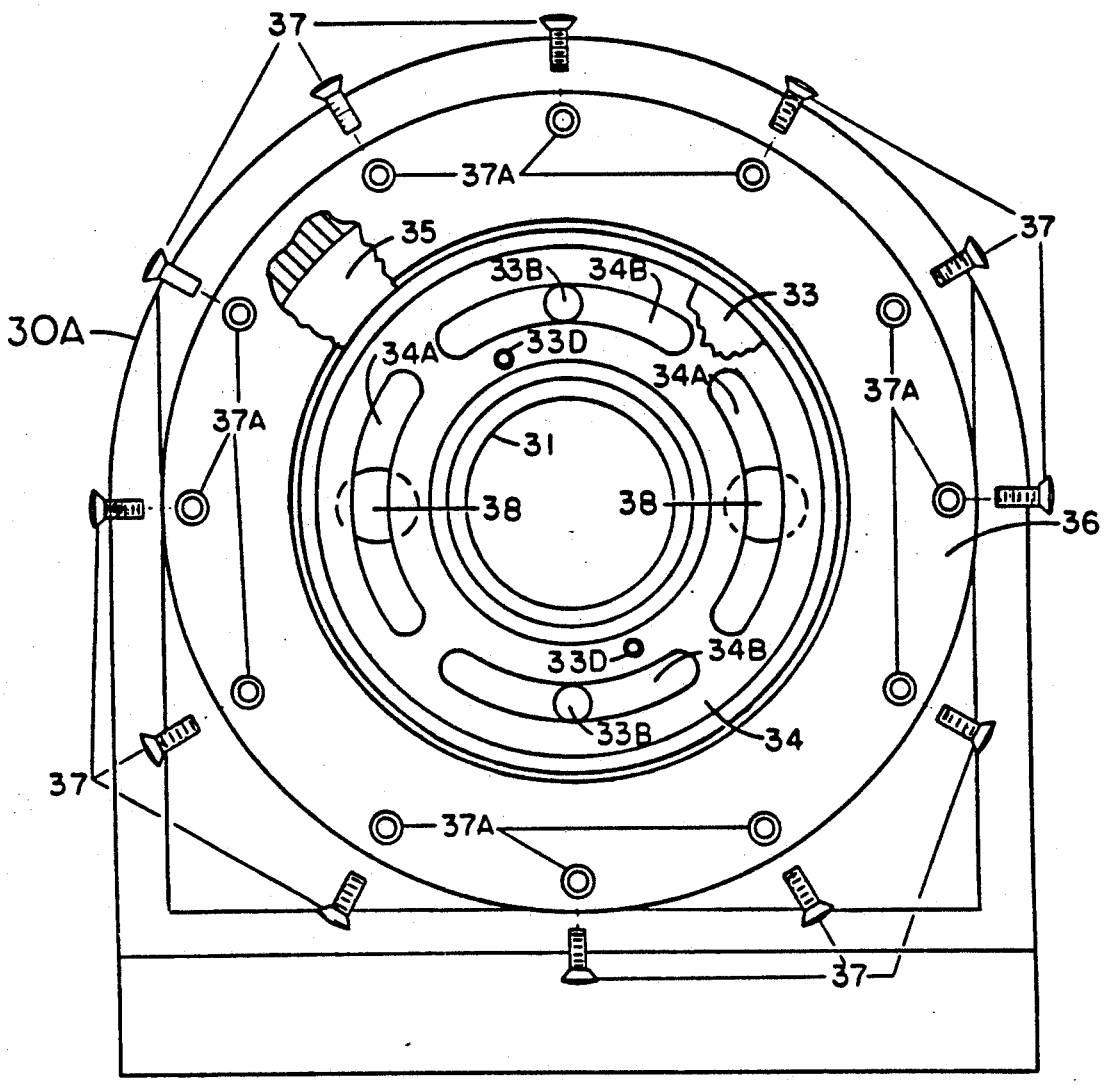
FIG. 3J is a vertical elevation partially exploded view of rear housing assembly.

FIG. 3J is an inside elevation view of rear housing 30A, plain bearing 31, o-ring 32, port plate 33, port valve plate 34, oil seal 35. Keeper ring 36 is fastened to 30A with oval head screws 37 through beveled holes 37A to threaded holes 37B. This composes the rear housing assembly.

Figure 4:
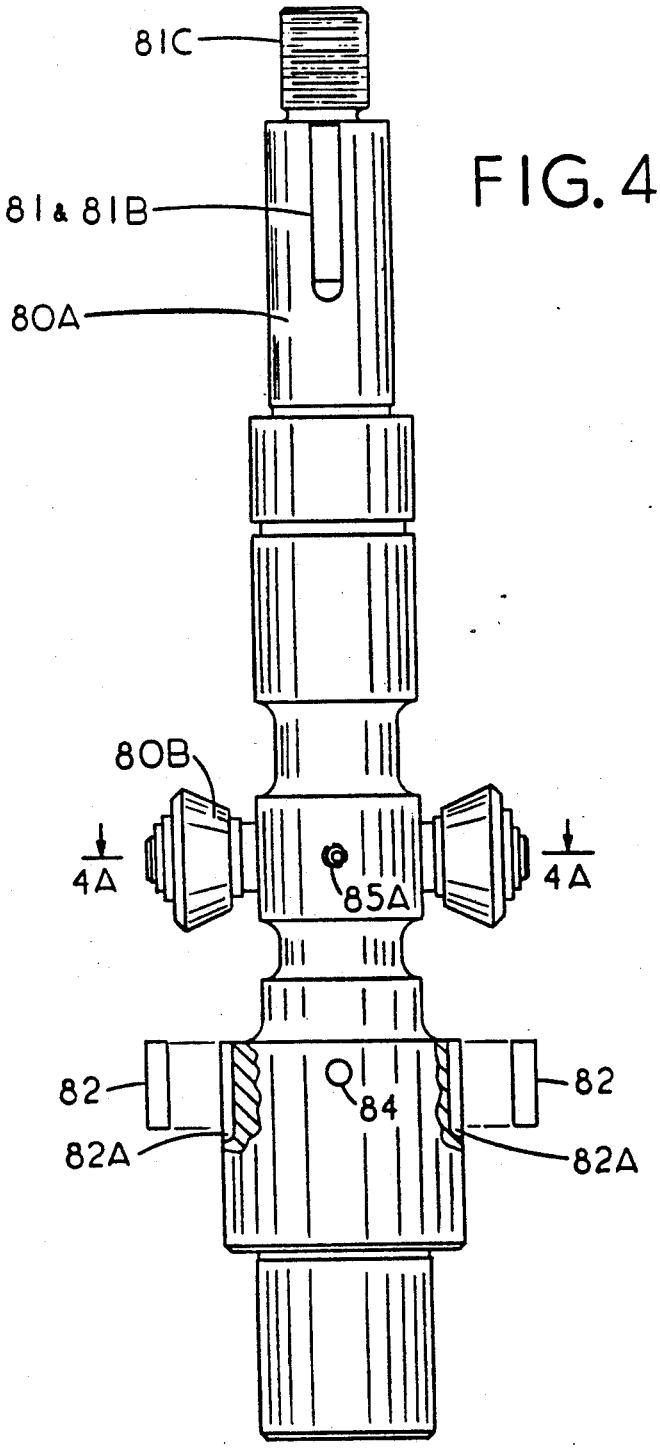
FIG. 4 is a assembly view of drive shaft.
Figure 4A:
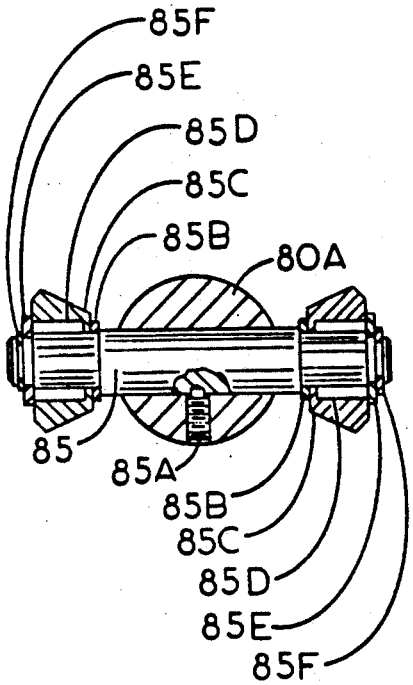
FIG. 4A is a cross section of torque actuator assembly on line 4A—4A.
Figure 5:
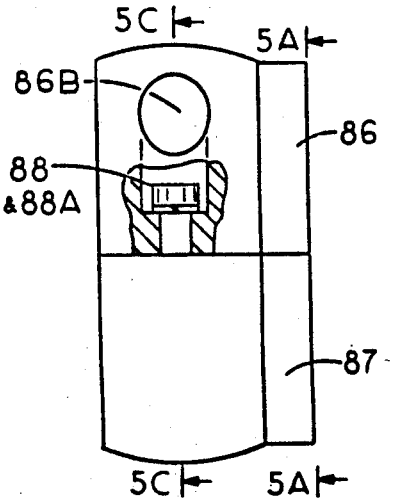
FIG. 5 is a side elevation of thrust yoke assembly.
Figure 5A:
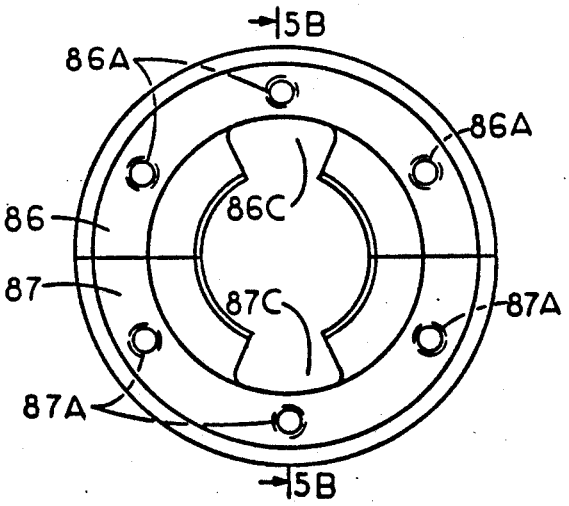
FIG. 5A is a front elevation of thrust yoke assembly on line 5A—5A.
Figure 5B:
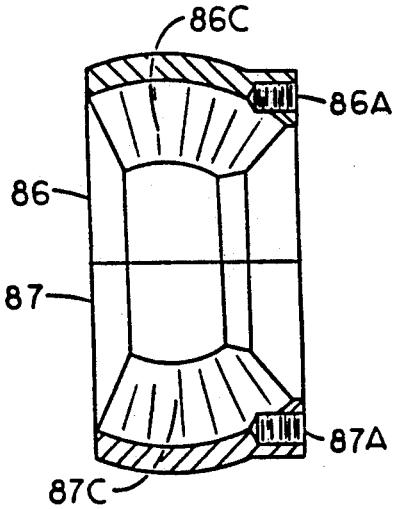
FIG. 5B is a vertical cross section of thrust yoke on line 5B—5B.
Figure 5C:
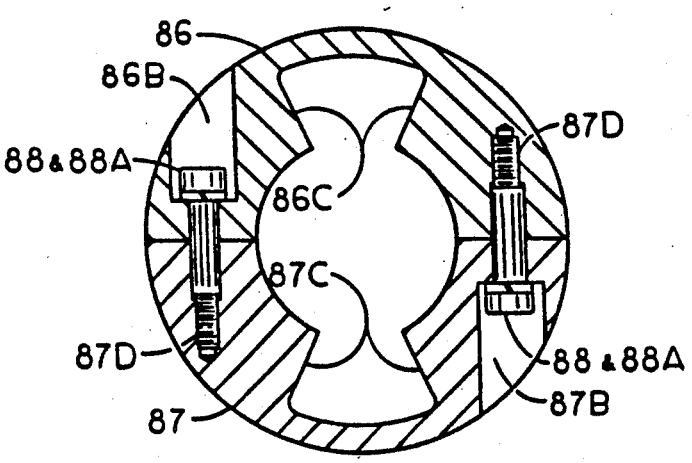
FIG. 5C is a cross section of thrust yoke on line 5C—5C.

FIG. 4 and FIG. 4A show drive show drive shaft assembly 80, drive shaft 80A torque actuator assembly 80B, key 81, key slot 81B, threaded shaft 81C, keys 82, key slots 82A, pin holes 84, thrust pin 85, socket head screw 85A, plain washers 85B, bearing cones 85C, needle bearings 85D, plain washers 85E, and snap rings 85F. This composes the drive shaft assembly.

FIG. 5, FIG. 5A, FIG. 5B, and FIG. 5C, show thrust yoke assembly 89 consisting of upper yoke half 86, threaded holes 86A, bolt well 86B, dovetail angular mortise 86C, lower yoke half 87 threaded holes 87A, bolt well 87B, dovetail angular mortise 87C, threaded holes 87D, shoulder screws 88, and lock washers 88A. This composes the thrust yoke assembly.

FIGS. 6, 6A, 6B, 6C, and 6E, show cylinder block assembly 40 consisting of cylinder block 40A, o-ring seal 41, seat 41A, fluid ports 42, pins 43, pin holes 43A, cylinders 44, rods 45, oil channels 45A, piston sleeves 46, piston rod seats 47, oil channels 47A, taper pins 48, tapered holes 48A, and keyways 49. This composes the cylinder block assembly 40.

FIGS. 7, 7A, 7B, and 7C, show piston rod support ring assembly 50, consisting of piston rod support ring 50A, piston rod anchor assembly 50B, cap screws 51, lock washers 52, outer rod seats 53, inner rod seats 54, holes 55, and threaded holes 56, hole 57, threaded holes 58 and 59, this composes the piston rod support ring assembly 50.

Figure 8:
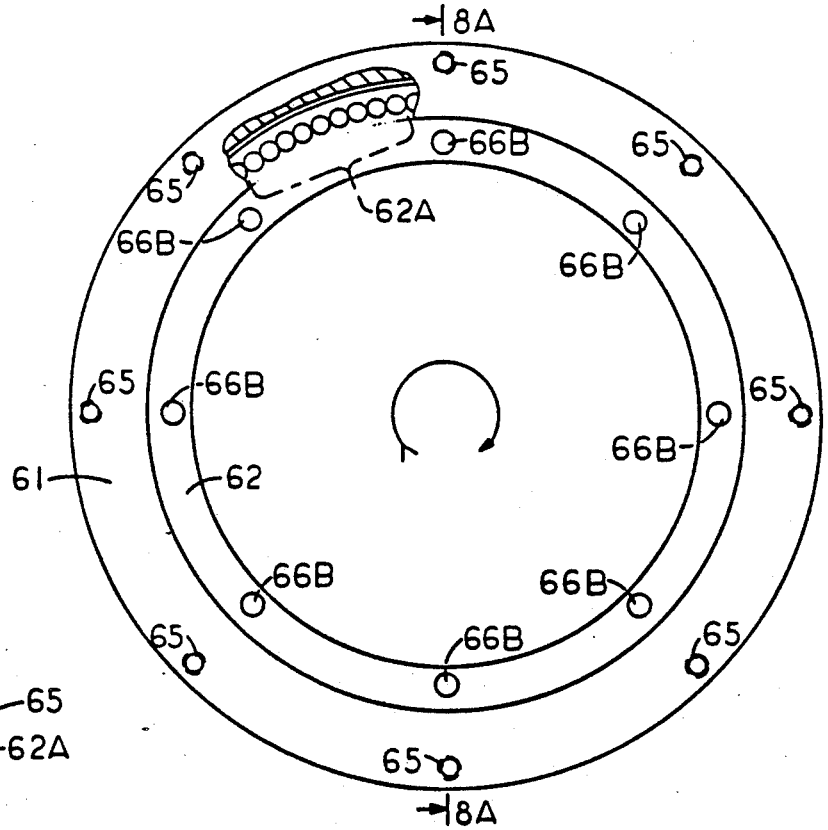
FIG. 8 is a front elevation partial assembly of thrust yoke positioner.
Figure 8A:
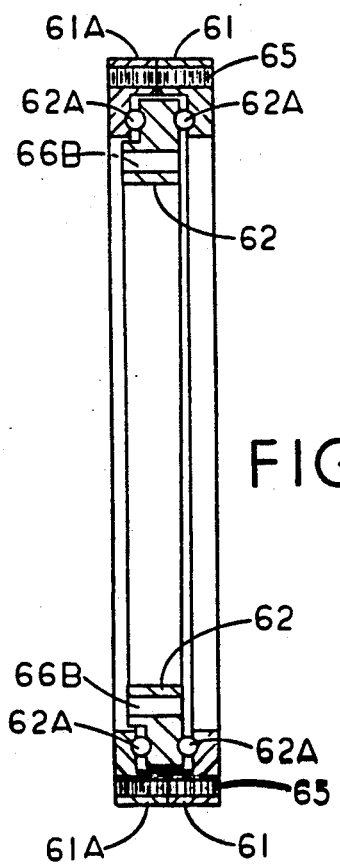
FIG. 8A is a cross section of thrust yoke positioner on line 8A—8A.

FIGS. 8 and 8A show thrust yoke positoner 60 partial assembly consisting of front race 61, rear race 61A, inner race 62, ball bearing 62A, threaded holes 65, and holes 66B.

Figure 9:
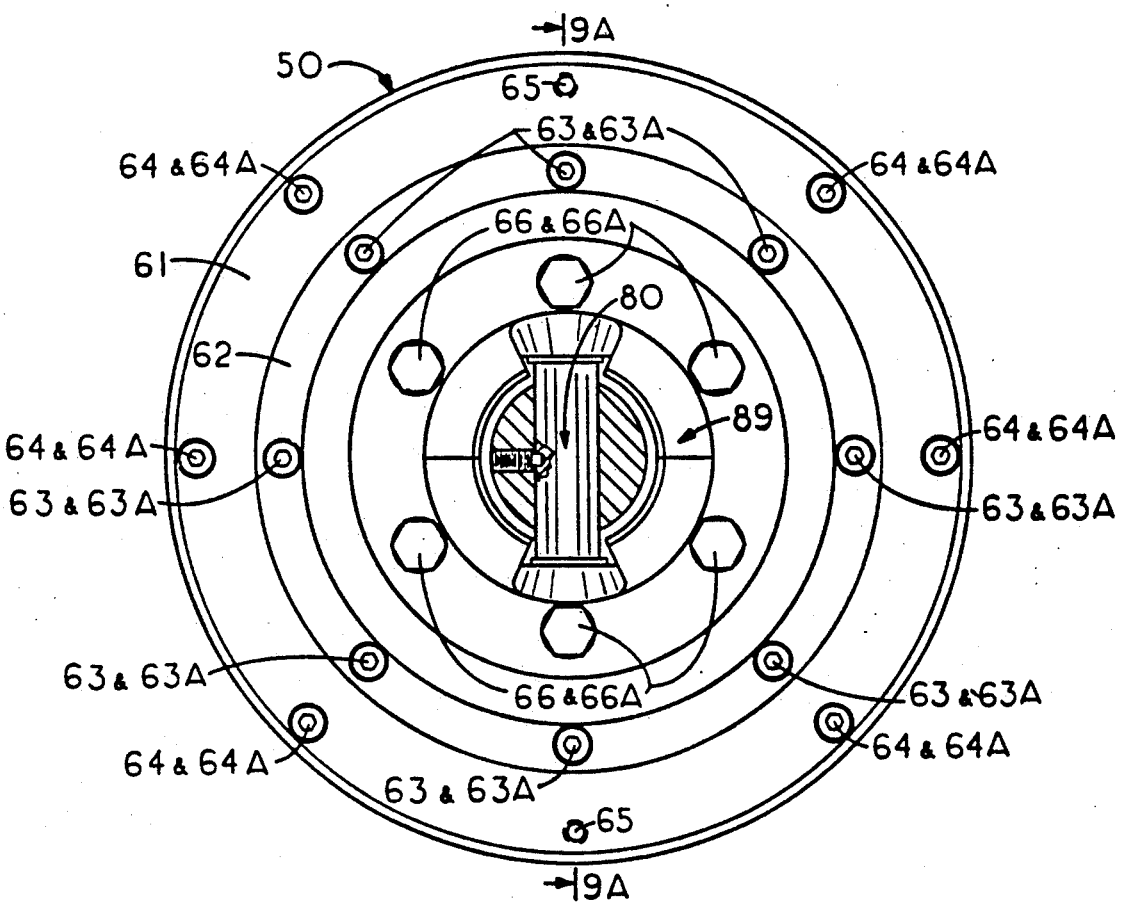
FIG. 9 is a front elevation of thrust yoke positioner assembly installed on drive shaft.
Figure 9A:
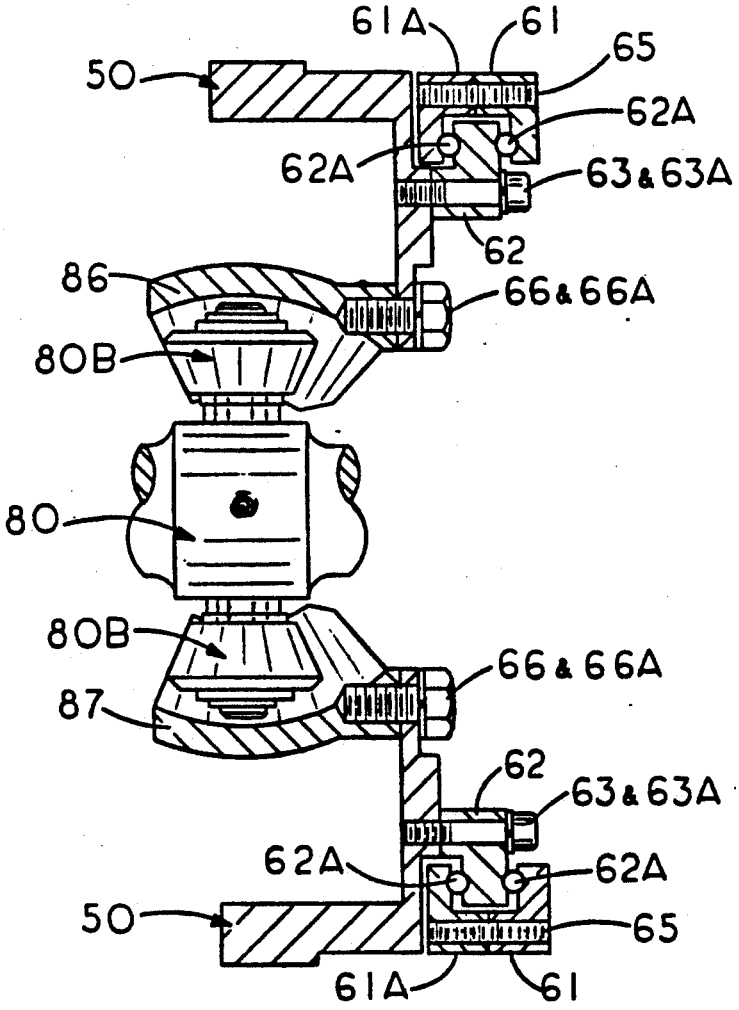
FIG. 9A is a vertical cross section of thrust yoke positioner assembly on line 9A—9A.
Figure 10:
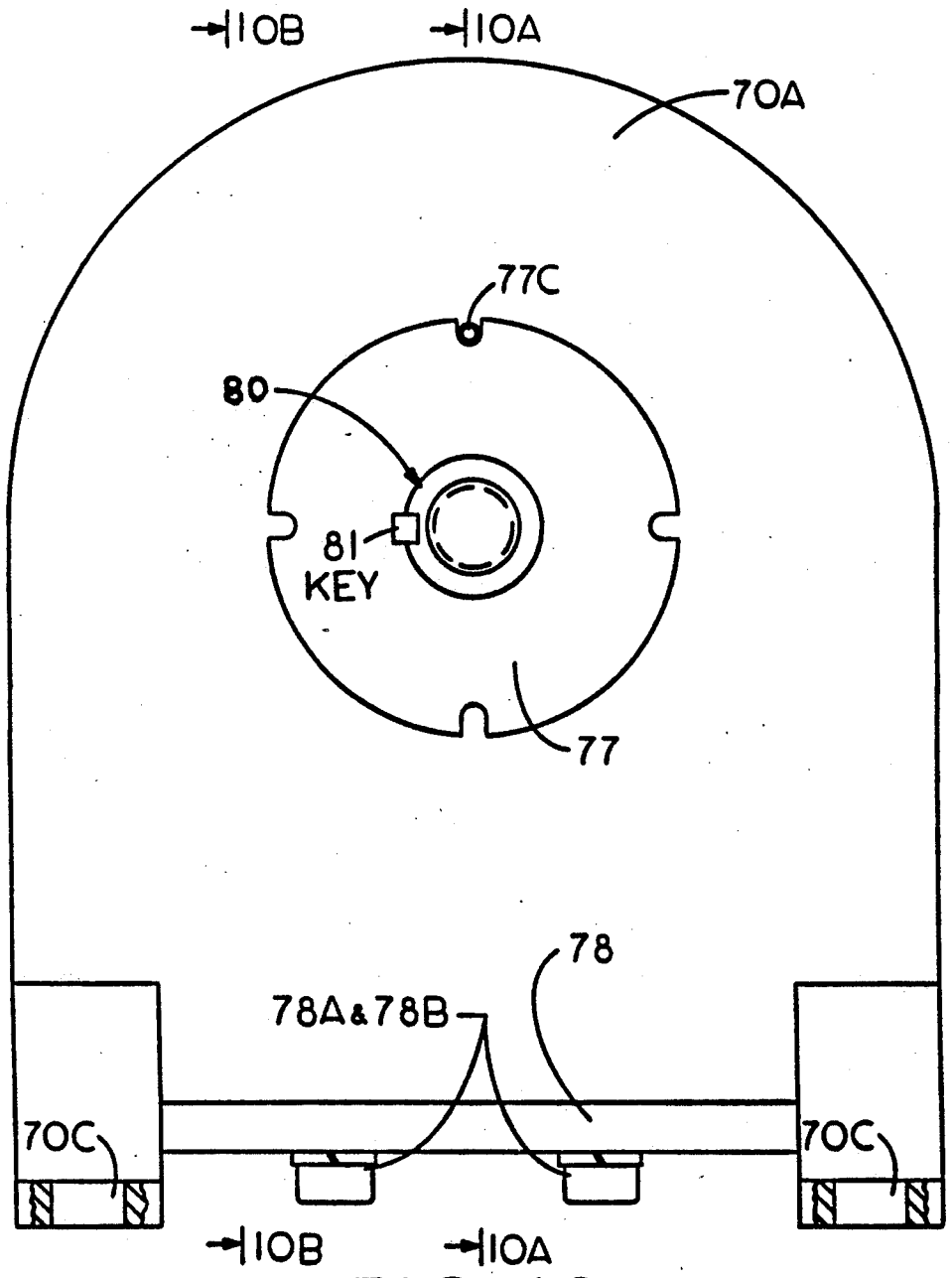
FIG. 10 is a front elevation of front housing and base structure assembly.
Figure 10A:
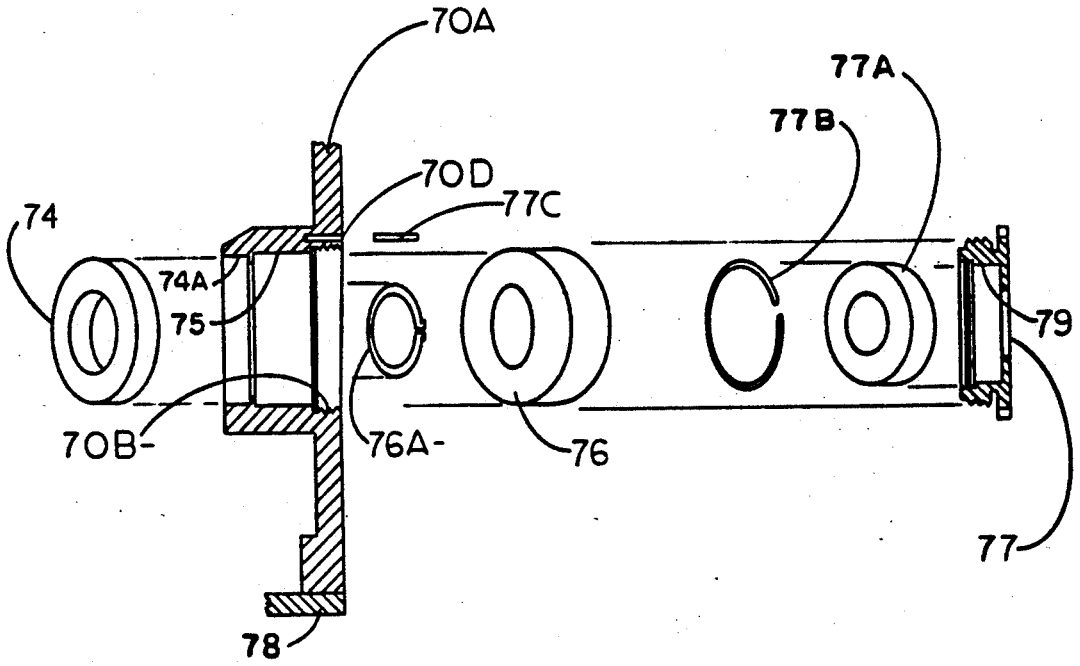
FIG. 10A is a cross section exploded view of front housing bearing compartment on line 10A—10A.
Figure 10B:
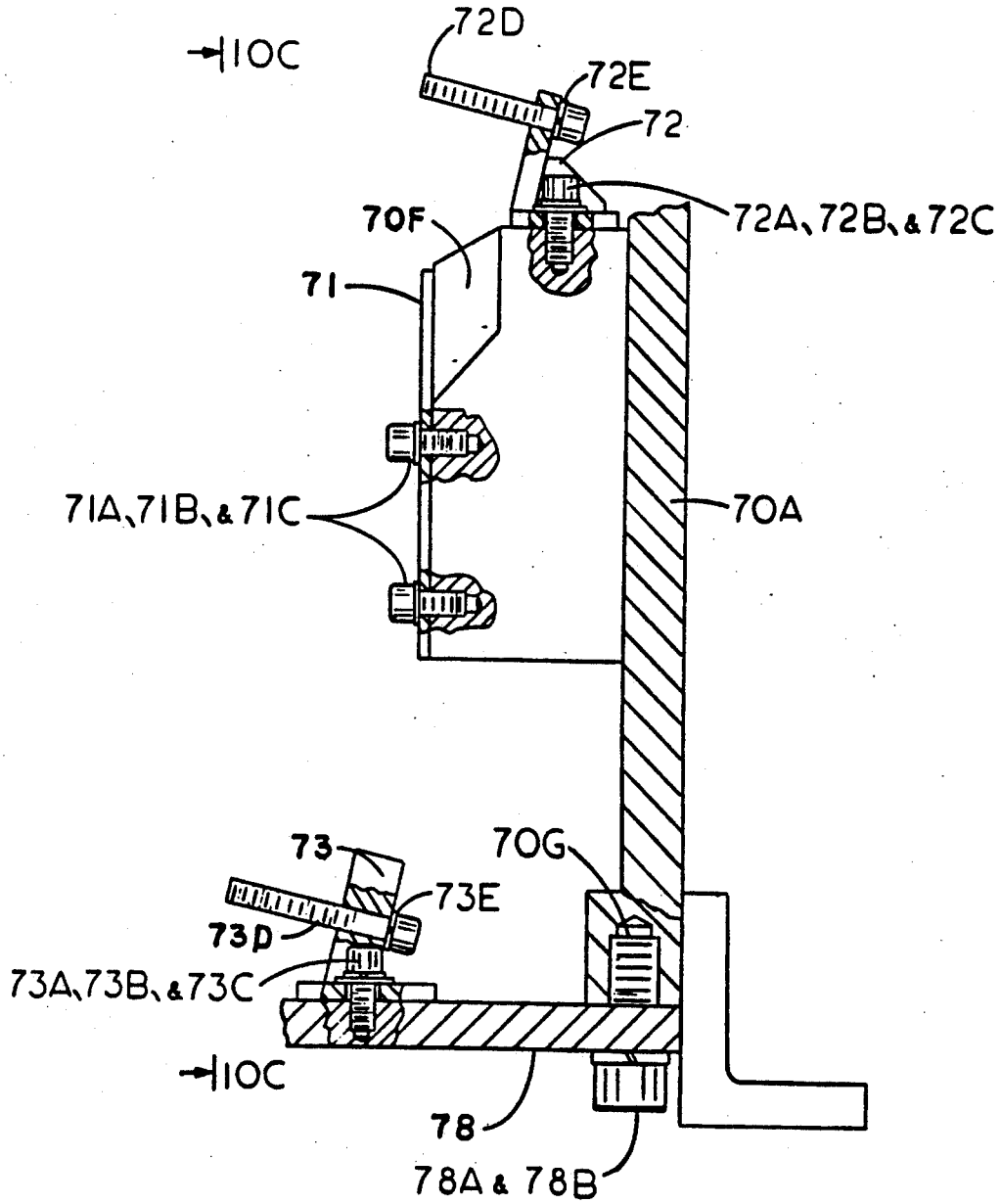
FIG. 10B is a vertical section view of front bearing compartment and positioner mounting brackets on line 10B—10B.
Figure 10C:
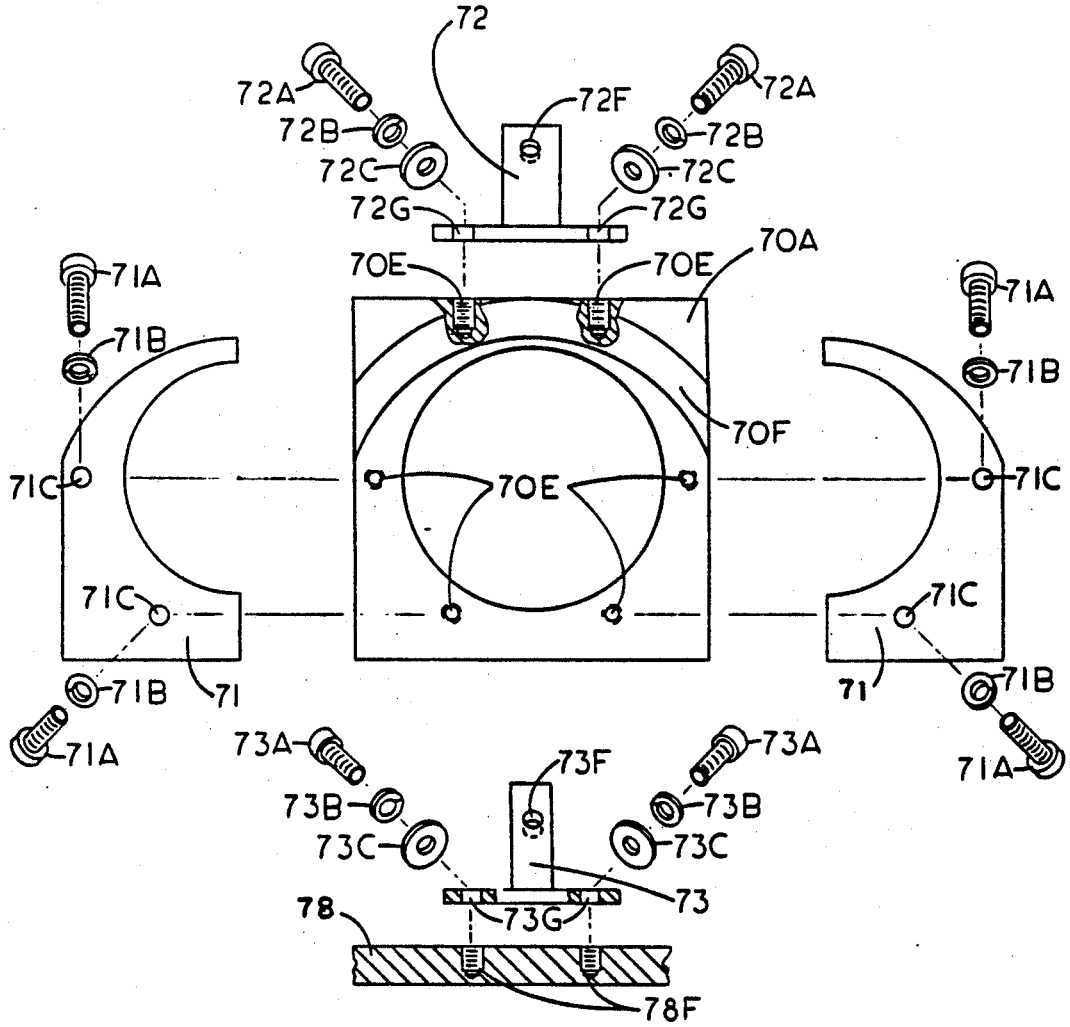
FIG. 10C is a front elevation exploded view of front housing inside cover and positioner mounting brackets on line 10C—10C.
Figure 10D:
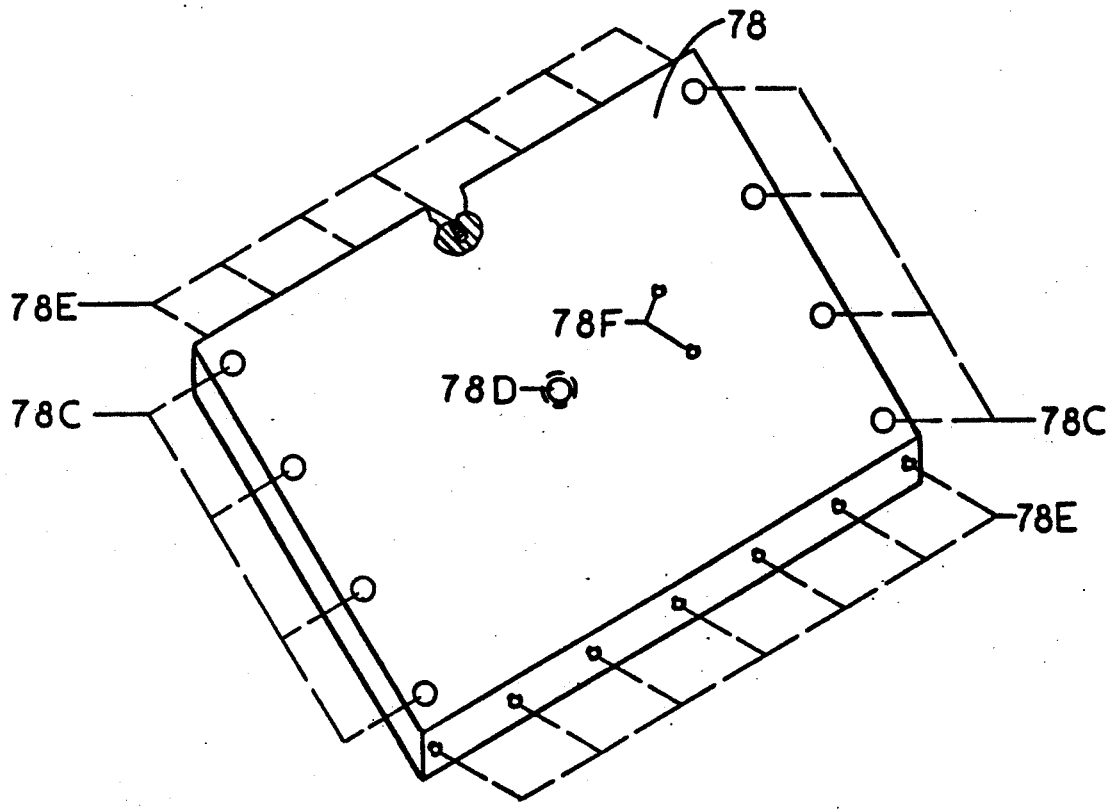
FIG. 10D is an isometric view of base plate fastener locations.

FIGS. 9 and 9A show thrust yoke positioner assembly 60 connected to thrust yoke assembly 89 and piston rod support ring assembly 50. Prior to this attachment, main assembly of component parts comprise: First step: drive shaft assembly 80. Second step: thrust yoke assembly 89, is located on torque actuator assembly 80B. Third step: cylinder block assembly 40 is mounted to drive shaft assembly 80.

Fourth step: this assemblage is installed into rear housing assembly 30. Fifth step: piston rods 45 are inserted and attached to piston rod anchor assemblies 50B with bolts 51, lock washer 52, inserted through holes 57, and connected to threaded holes 58 and 59, located on piston rod support ring 50A.

Sixth step: thrust yoke assembly 89 is connected to piston rod support ring 50 with cap screws 66, lock washers 66A, inserted through holes 55, and connected to threaded holes 86A, and 87A, on thrust yoke assembly 89. Seventh step: thrust yoke positioner 60 is connected to piston rod support ring 50, with cap screws 63, lock washers 63A, inserted through holes 66B and connected to threaded holes 56 on piston rod support ring assembly 50.

FIGS. 10, 10A, 10B, 10C, and 10D, show front housing and base structure assembly 70, consisting of front housing 70A, threaded seat 70B, lugs 70C, pin hole 70D, threaded holes 70E, circular bevel 70F, threaded holes 70G, split cover 71, cap screws 71A, lock washers 71B, upper mounting bracket 72, cap screws 72A, lock washers 72B, plain washers 72C, anchor bolt 72D, lock washer 72E hole 72F, slotted holes 72G, lower mounting bracket 73, cap screws 73A, lock washers 73B, plain washers 73C, anchor bolt 73D, lock washer 73E, hole 73F, slotted holes 73G, oil seal 74, seal seat 74A, bearing seat 75, tapered roller bearing 76, snap ring 76A, threaded end cover 77, oil seal 77A, snap ring 77B, base plate 78, bolts 78A, lock washers 78B, holes 78C, threaded hole 78D, threaded holes 78E, threaded holes 78F, and seal seat 79.

Continuation of main assembly component parts are, Eighth step: oil seal 74 is positioned in seal seat 74A. Snap ring 76A is positioned on drive shaft assembly 80. Rear housing 70A is attached to base plate 78 with bolts 78A with lock washers 78B, through holes 78C to threaded holes 70G, Tapered roller bearing 76 is positioned in bearing seat 75 in front housing 70A. Split cover 71 is attached to front housing 70A utilizing bolts 71A with lock washers 71B, inserted through holes 71C to threaded holes 70E. Upper mounting bracket 72 is mounted to front bearing compartment on housing 70A utilizing bolts 72A, washers 72B plain washers 72C, through sloted holes 72G to threaded holes 70E. Lower mounting bracket is fastened to base plate 78 utililzing bolts 73A, lock washers 73B, plain washers 73C through slotted holes 73G to threaded holes 78F on base plate 78.

Continuation of main assembly component parts are Ninth step: anchor bolt 72D with lock washer 72E through hole 72F is connected to threaded hole 65 on thrust yoke positioner assembly 60. Anchor bolt 73D with lock washer 73E though hole 73F is connected to threaded hole 65 on thrust yoke positioner assembly 60. Oil seal 77A is positioned in threaded end cover 77 seal seat 79. Snap ring 77B is installed in threaded end cover 77. Threaded end cover 77 is positioned in threaded seat 70B on rear housing 70A. Pin 77c is inserted in pin hole 70D on rear housing 70A. This completes the main assembly.

Figure 11:
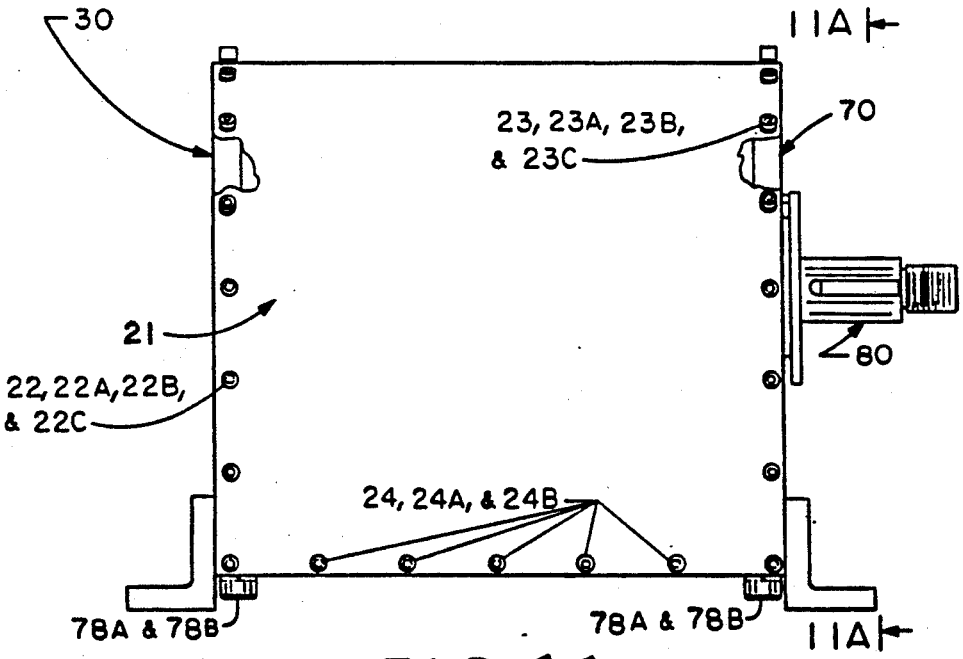
FIG. 11 is a side elevation of encasement assembly.
Figure 11A:
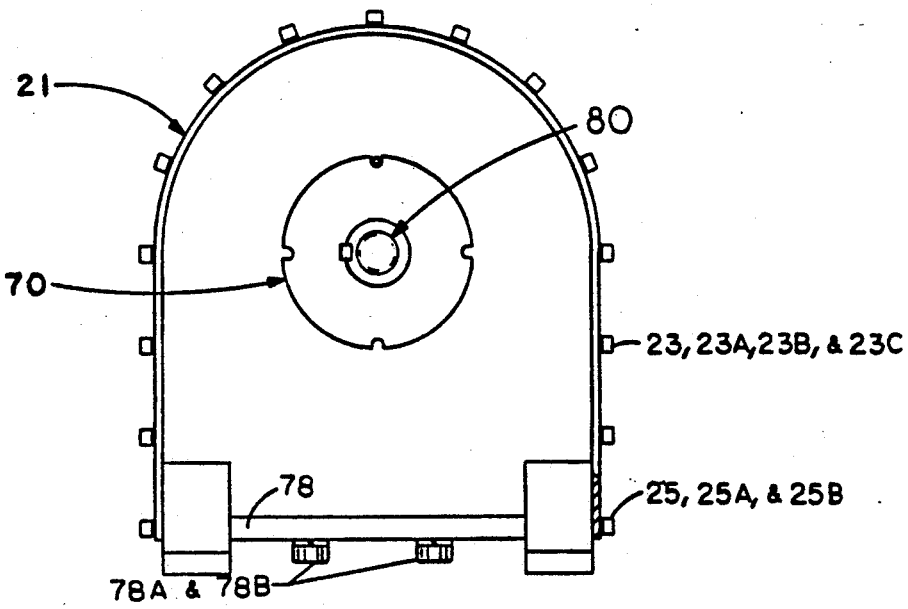
FIG. 11A is a front elevation of encasement assembly.

FIGS. 11, and 11A, side and front elevations, show encasement assembly 20 consisting of, cover assembly 21 connection to rear housing 30 with cap screws 22, with lock washers 22A, through holes 22B to threaded holes 22C, connection to front housing assembly 70 with cap screws 23, with lock washers 23A, through holes 23B to threaded holes 23C. Cover 21 connection to left side of base plate 78 with cap screws 24, with lock washers 24A through holes 24B to threaded holes 78E. Cover 21 connection to right side of base plate 78 with cap screws 25, lock washers 25A, through holes 25B to threaded holes 78E on base plate 78. This composes the encasement assembly.

Figure 12:
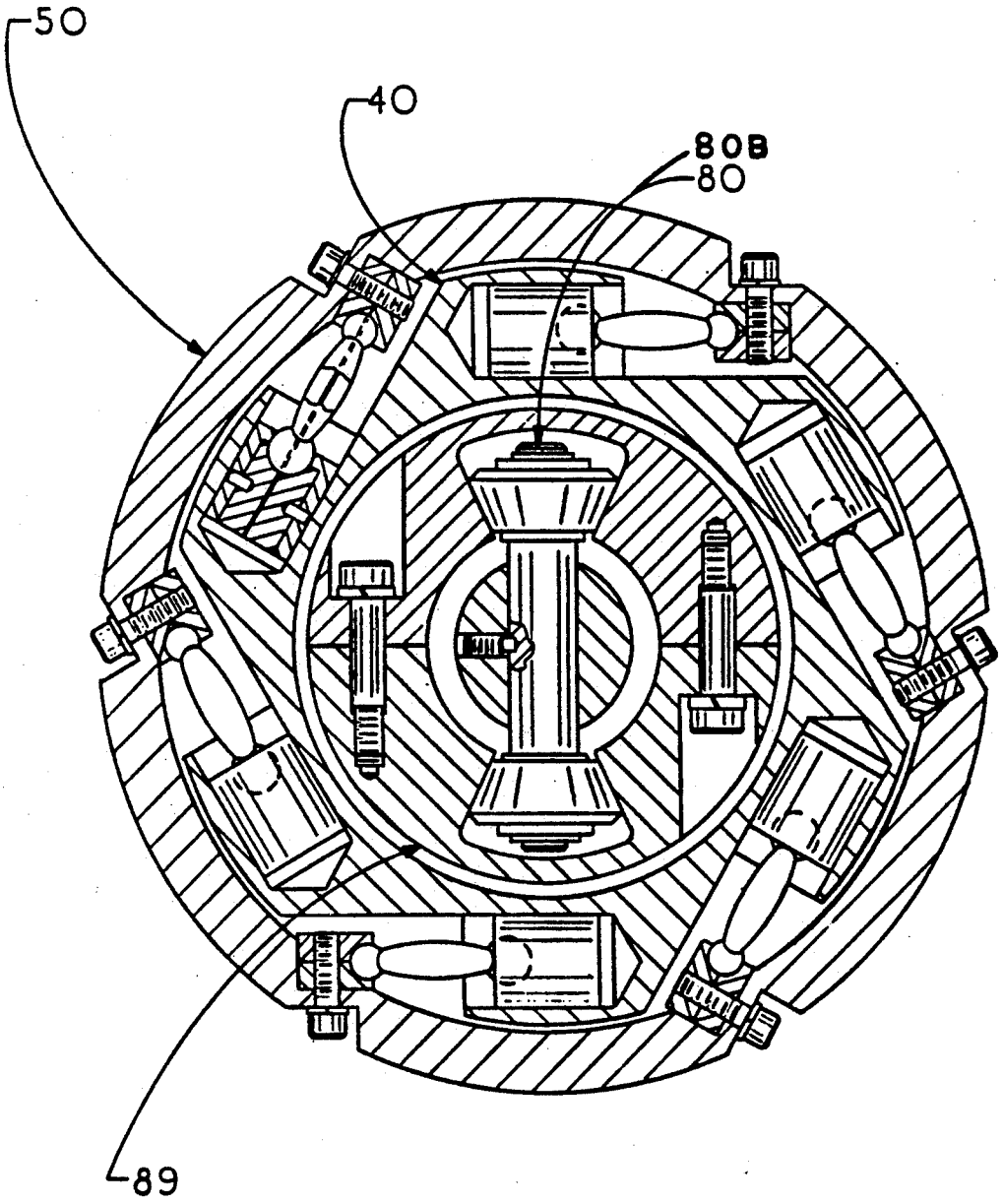
FIG. 12 is a cross section showing the interrelation of the rotating power train assemblies.

FIG. 12 shows a vertical cross section of rotating assemblies on cylinder block rotation axis. The torque actuator maintains the power thrust at right angles to the output shaft during rotation and the angular momentum is directed along the rotation axis.

Figure 13:
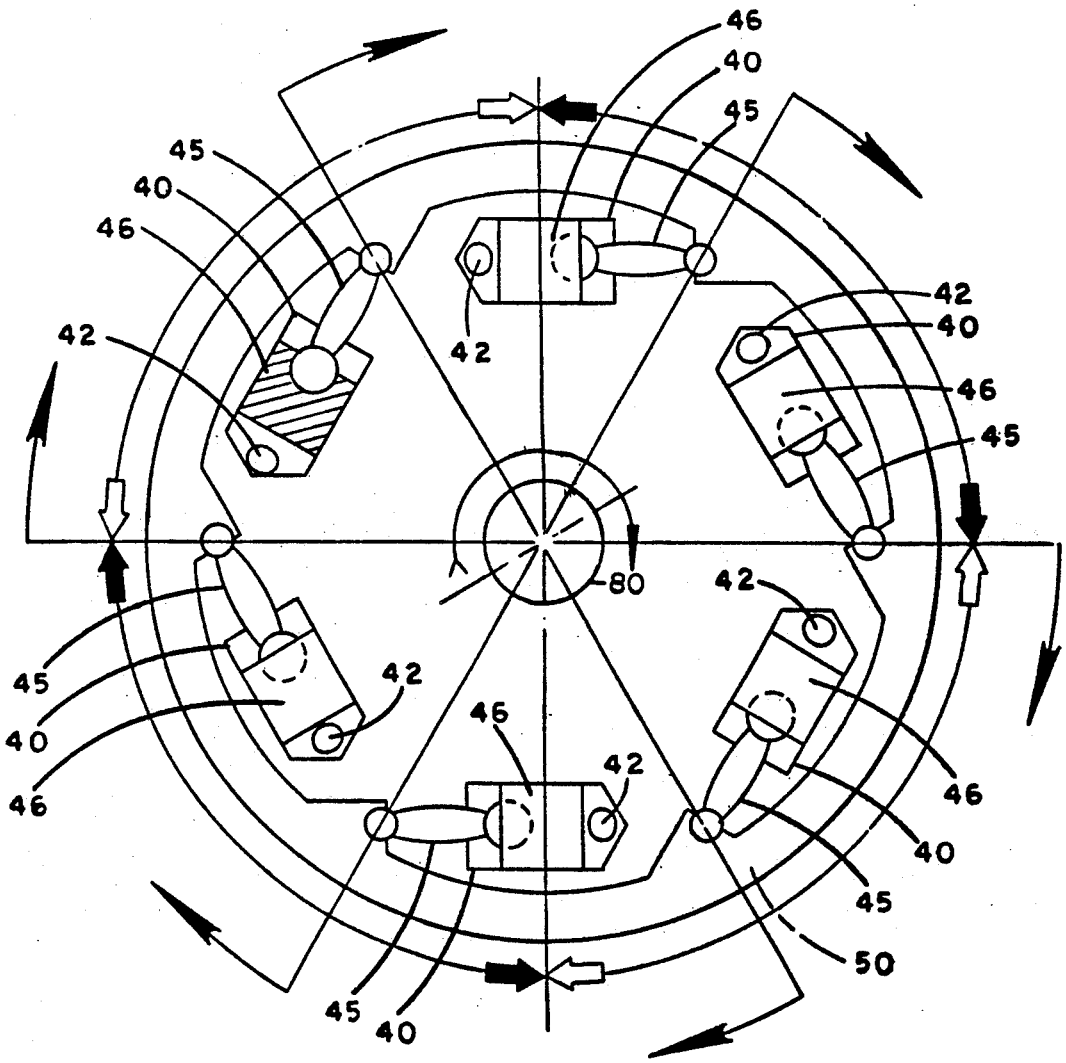
FIG. 13 is a diagrammatic of power movements and exhaust cycle sequences.

FIG. 13 is a diagrammatic of the operational power moment sequences during rotational motion throughout the entire 360 degrees of rotation during the constant input flow. The force applied to the piston rod is transferred mechanically to the axis on drive shaft by the piston rod support ring and magnified by the radius distance.

The effort force moves around the circumference of the rod support ring which has a greater radius than the drive shaft axis. The effort applied to the axis per cylinder is magnified by this radius distance. Since both the rod support ring and the drive shaft movements occur in the same time interval it is clear that the effort force at the rod support ring had to move faster as well as farther than the drive shaft. We have obtained and increase in force with a reduction in speed.

Figure 14:
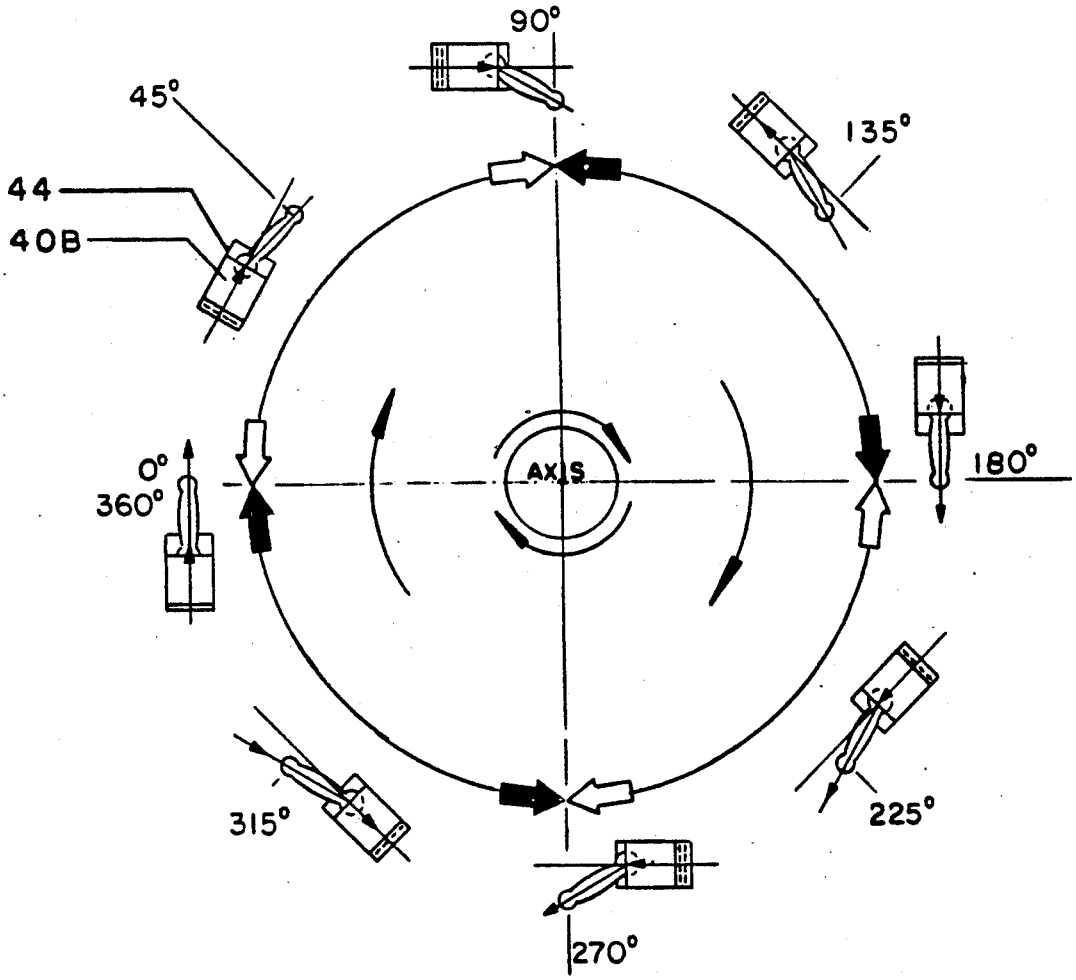
FIG. 14 is a diagrammatic of piston and rod transitional gradation through one revolution.

FIG. 14 is a diagrammatic of one power cylinder and rod motion activity during one complete 360 degree rotation. Angularity of piston rod support ring (50) allows piston rod anchored end to traverse laterally along horizontal axis during rotation. Piston rod support ring (50) maintains position of rod anchored end in relation to center axis of rotation during lateral travel.

Diagram is based on a piston diameter of 25.4 millimeters. A rod length of 38.1 millimeters. Rod maximum lateral travel of 19 millilmeters. A radius of 96.52 millimeters. During rotational power movements piston travels centrifugally 5.08 millimeters. Volume per cylinder per power stroke is about 2.57 milliliters. Motor displacement is 30.8 milliliters per revolution. Demonstrating the high volumetric efficiency of the centrifugal piston motor.

Figure 15:
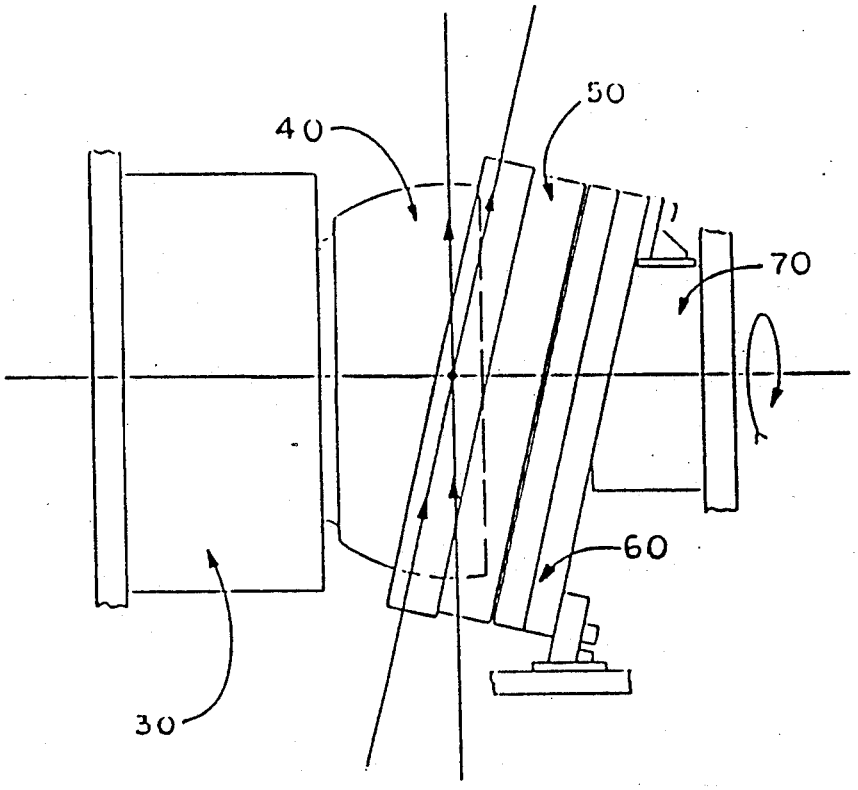
FIG. 15 is a diagrammatic of angular rotational functions.

FIG. 15 is a diagrammatic showing locations of assemblies 30, 40, 60, and 70 in relation to rotational axis of piston rod support ring 50.

The hydraulic centrifugal piston motor is presented as a motor having multiple pistons disposed with their axis at right angles to shaft axis. FIGS. 1, 1A, and 2, display a unitized assemblage of six subassemblies, namely 30, 40, 60, 70, and 80, to comprise a main assembly.

Operations begin when pressurized hydraulic fluid is ported into rear housing 30 through two inlet ports 38, FIG. 3. Fluid is ported through port plate 33, FIG. 3F, allowing pressure loading of port valve plate 34, FIGS. 3G and 3H, to minimize clearance leakage losses and allow for thermal changes during operations of valving lands contact face.

Plain bearing 31, FIG. 3A, located in housing 30, provides a cantilever seat for drive shaft 80, FIG. 4. o-ring seal 32, FIG. D, and oil seat 35, FIG. 3E, is positioned in housing 30 to keep fluid leakage at a minimum during operations.

FIG. 3B shows two fluid inlet ports 38, located on left and right side of housing 30 to provide input pressure for balanced rotational motion during constant input flow.

FIGS. 3C, and 3J, show housing 30 circular seating and assembly locations of bearing 31, o-ring 32, port plate 33, pin 33D, port valve plate 34, oil seal 35, and keeper ring 36.

FIGS. 5, 5A, 5B, 5C, show view of thrust yoke assembly 89. Upper yoke half 86 and lower yoke half 87 are positioned on torque actuator assemgly 80B and secured with fasteners 88 and 88A. Dovetail angular mortise 86C and 87C allows thrust yoke 89 to oscillate by angular motion about the vertical axis of torque actuator 80B, FIG. 4A, during rotation of piston rod support ring 50, FIG. 7. Torque actuator 80B maintains power thrust at right angle to output shaft 80 maintains power thrust at right angle to output shaft 80 during rotation and the angular momentum is directed along the rotation axis.

Figure 6:
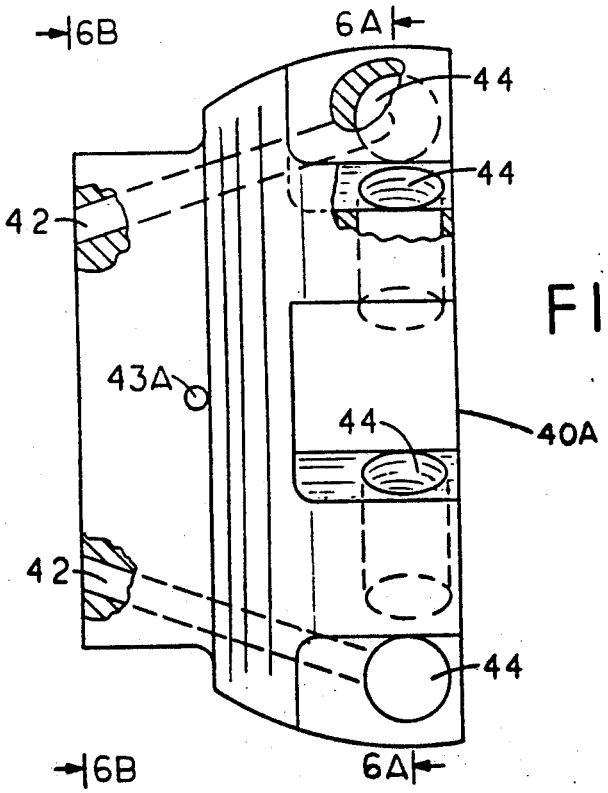
FIG. 6 is a side elevation of cylinder block.
Figure 6A:
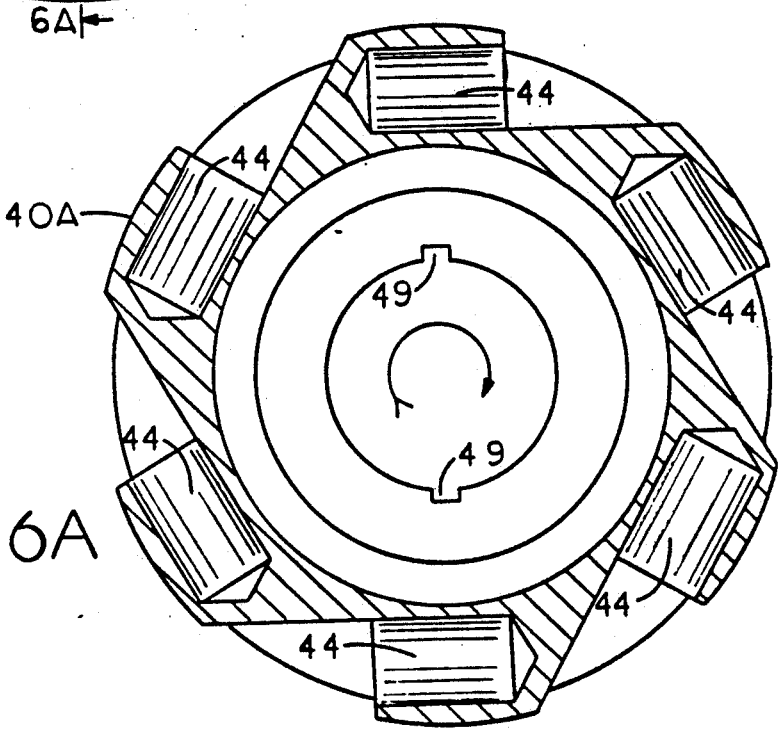
FIG. 6A is a vertical cross section of cylinder block on line 6A—6A.
Figure 6B:
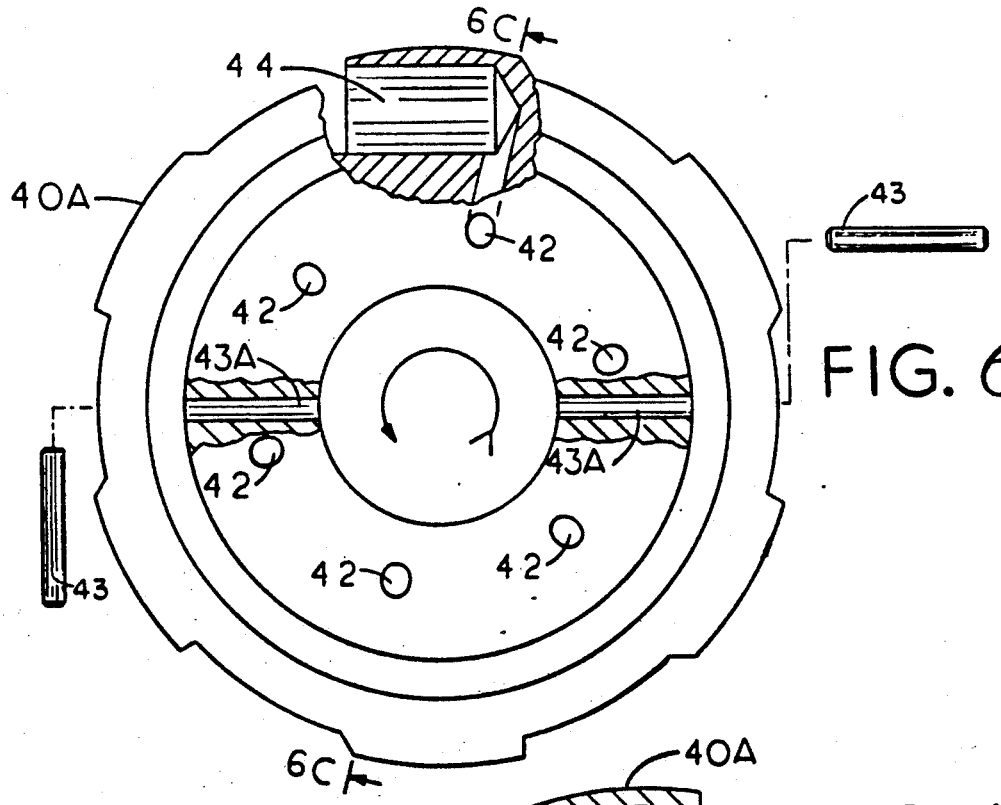
FIG. 6B is a rear elevation view of cylinder block on line 6B—6B.
Figure 6C:
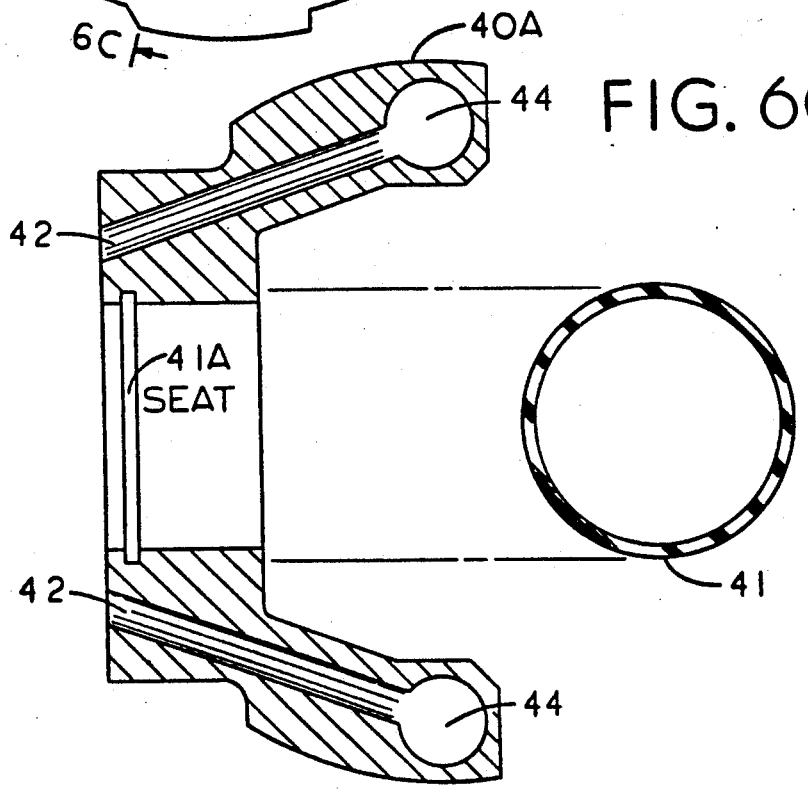
FIG. 6C is a cross section of cylinder block on line 6C—6C.

FIGS. 6, 6A, 6B, 6C, 6D, and 6E show cylinder block assembly 40 and piston and rod assembly 40B. o-ring 41, FIG. 6C, is installed in seat 41A in cylinder block 40A. Cylinder block 40A is connected to shaft 80A, FIG. 4, in alignment with keyways 49 and keyways 82A and secured with keys 82. Pins 43 are inserted through holes 43A to holes 84. Six piston and rod assemblies 40B are positioned in the six cylinders 44. The primary piston operation forces are carried on hydrostatically supported seats through oil channels 45A and 47A, FIG. 6E. Inlet pressure is carried through the cylinder to rod seat 47, FIG. 6E. Inlet pressure is carried through the piston rod 45 to outer rod seat 53 and inner rod seat 54, FIG. 7C. Contact pressure on the seat surfaces minimizes losses from the hydrostatic pool.

Figure 6D:
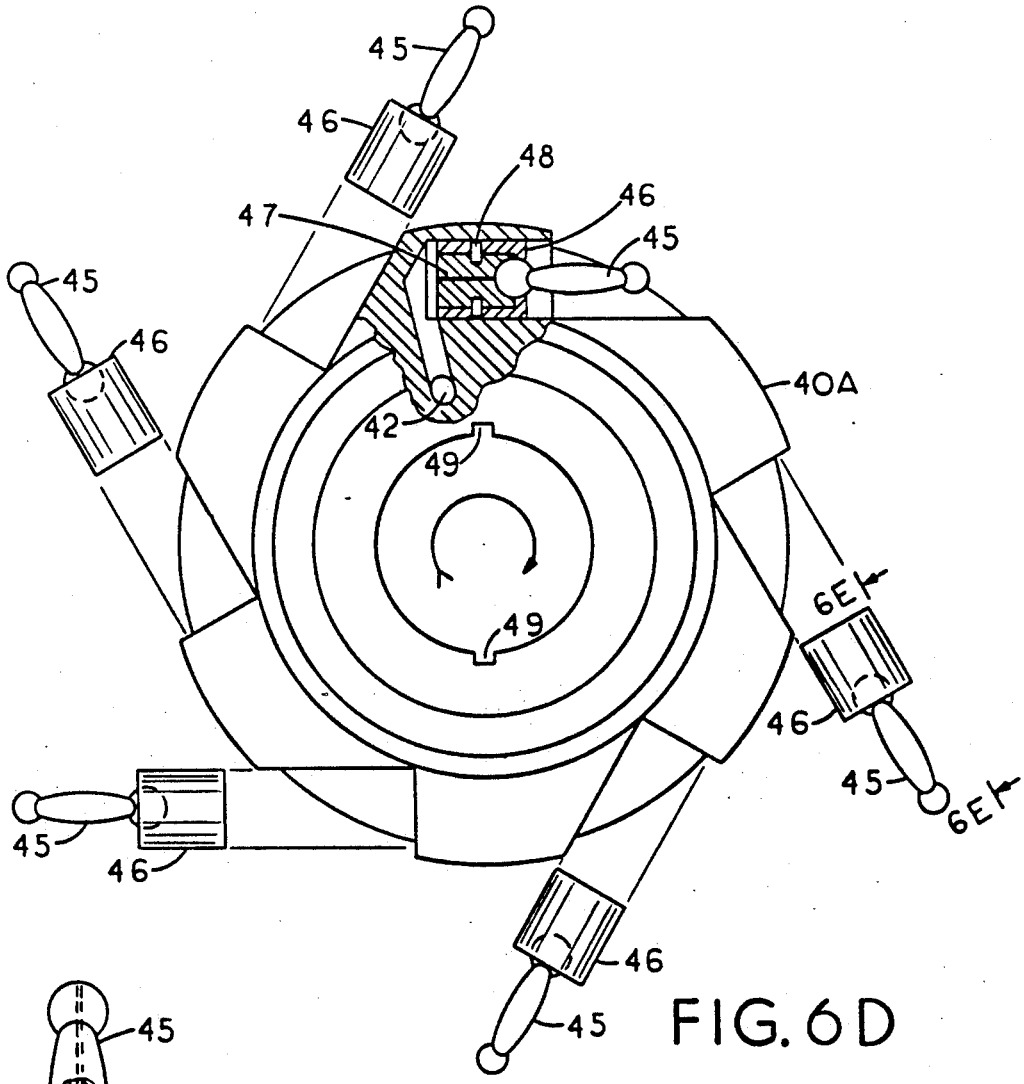
FIG. 6D is a front elevation exploded view of cylinder block assembly.
Figure 6E:
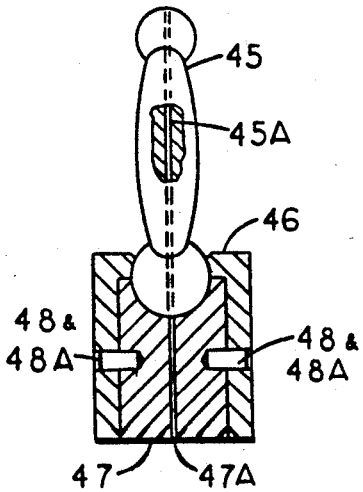
FIG. 6E is a cross section of piston and rod assembly on line 6E—6E.
Figure 7:
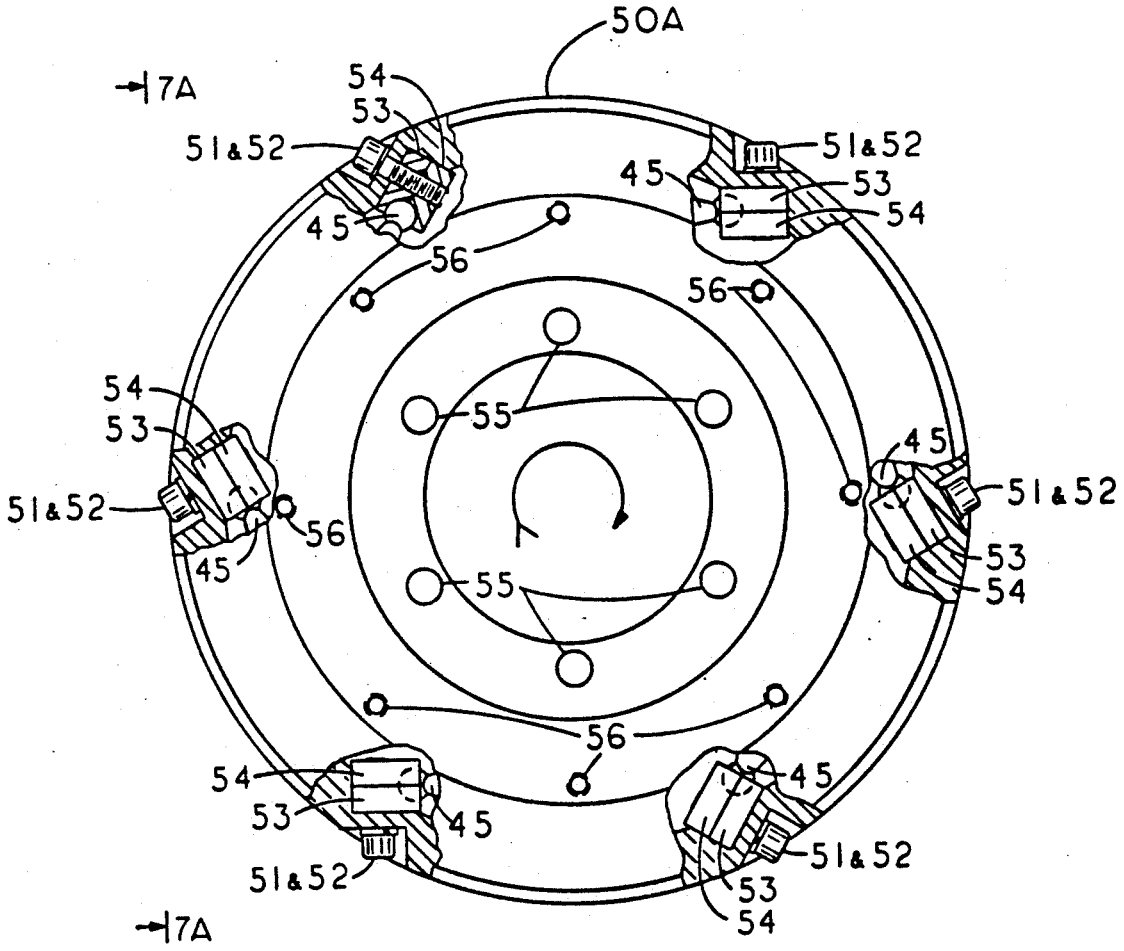
FIG. 7 is a front elevation of piston rod support ring assembly.
Figure 7C:
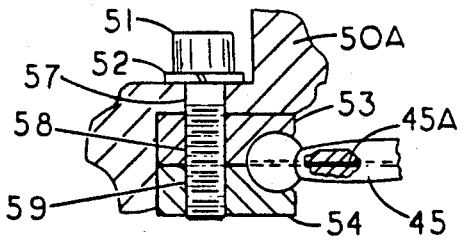
FIG. 7C is a cross section of piston rod anchor assembly on line 7C—7C.
Figure 7A:
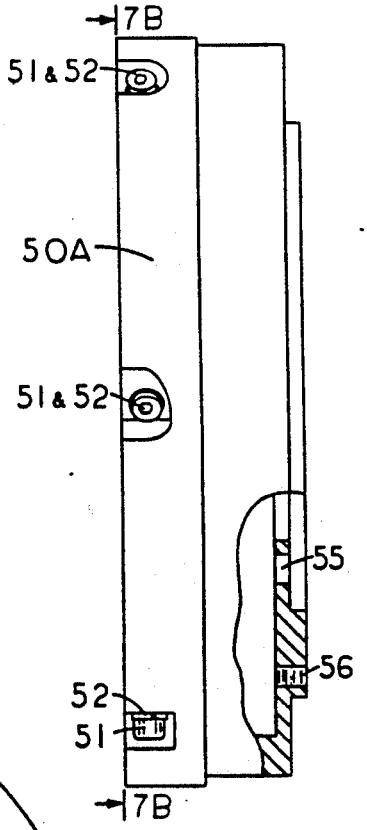
FIG. 7A is a side elevation of piston rod support ring assembly on line 7A—7A.
Figure 7B:
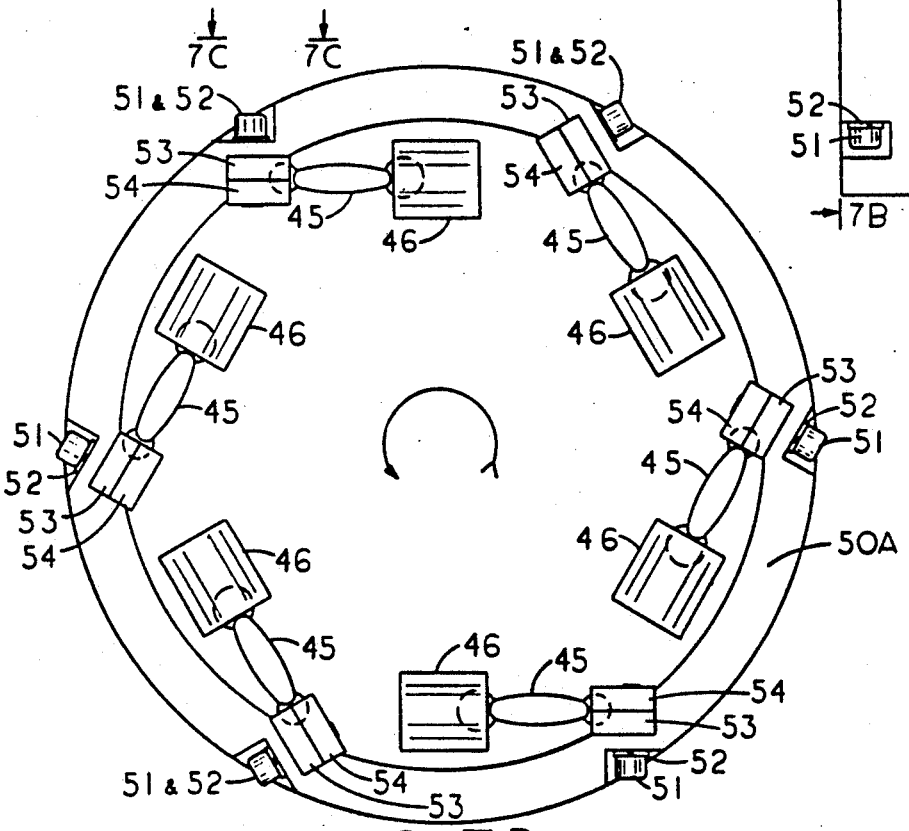
FIG. 7B is a rear elevation of piston rod support ring assembly on line 7B—7B.

FIGS. 7, 7A, 7B, and 7C show piston rod support ring assembly 50 and piston rod anchor assembly 50B. Piston rod support ring 50A is positioned on shaft 80A, aligned and connected to thrust assembly 89 with fasteners 66, and 66A, FIG. 9, through holes 55 to threaded holes 86 and 87A, FIG. 5A. Six piston rods 45 FIG. 6D, are aligned and connected to support ring 50A with fasteners 51 and 52 through holes 57 to threaded holes 58 on outer rod seat 53 and threaded holes 59 on inner rod seat 54.

FIGS. 8, 8A, 9, 9A, show thrust yoke positioner assembly 60 and partial assembly 60A sections and elevation views. Front race 61 and rear race 61A, inner race 62, and bearings 62A, are aligned and connected with six fasteners, 64 and 64A, to threaded holes 65, three on each side leaving top center and bottom center threaded holes 65 open for later connection to anchor bolts. Assembly 60A is positioned on shaft 80 and connected to support ring 50 with fasteners 63 and 63A through holes 66B to threaded holes 56, FIG. 7. Thrust yoke positioner 60 is now attached to piston support ring 50 and thrust yoke 89 on drive shaft 80, FIG. 9.

FIGS. 10, 10A, 10B, 10C, and 10D show front housing and base structure assembly 70 elevation views and sections. Lower mounting bracket 73 is connected to base plate 78 with fasteners 73A, 73B, and 73C; through slotted holes 73G to threaded holes 78F. Upper mounting bracket 72 is connected to housing 70 bearing compartment with fasteners 72A, 72B, and 72C, through slotted holes 72G to threaded holes 70E. Oil seal 74 is positioned on shaft 80. Snap ring 76A is positioned on shaft 80. Front housing 70A is connected to base plate 78 with fasteners 79 and 79A through holes 78C to threaded holes 70G. Tapered roller bearing 76 is positioned in seat 75. Oil seal 77A is positioned in seal seat 79. Snap ring 77B is positioned in threaded end cover 77. End cover 77 is positioned in threaded seat 70B. Pin 77C is inserted in pin hole 70D. Split cover 71 is attached to housing 70A with fasteners 71A, and 71B through holes 71C to threaded holes 70E. Thrust yoke positioner 60, is connected to lower mounting bracket 73 with anchor bolt 73D and lock washer 73E at lower center threaded hole 65, FIG. 9. Thrust yoke positioner 60, is connected to upper mounting bracket 72 with anchor bolt 72D and lock washer 72E at upper center threaded hole 65, FIG. 9. Case drain 78D to reservoir is required to keep case pressure below motor outlet pressure. FIGS. 11, and 11A show side and front elevations of the encasement assembly 20. Cover assembly 21 is attached to rear housing 30, with fasteners 22, and 22A, through holes 22B to threaded holes 22C on housing 30, FIG. 2.

Cover assembly 21 is attached to front housing with fasteners 23 and 23A through holes 23B to threaded holes 23C on front housing 70, FIG. 2. Cover assembly 21 is attached to left side of base plate 78 with fasteners 24 and 24A, through holes 24B to threaded holes 78E, FIG. 10D. Cover assembly 21 is attached to right side of base plate 78 with fastener 25 and 25A, through holes 25B to threaded holes 78E, FIG. 10D.

FIG. 12 shows a cross section of cylinder block 40, piston rod support ring 50, drive shaft 80, and thrust yoke 89, at center of torque actuator prior to the anchoring of the thrust yoke positioner 60, FIG. 9A. All elements rotate clockwise.

FIG. 13 is a diagrammatic showing equal and opposite overlap of successive power stroke forces for rotational balance and reduced bearing loads for improved output torque and a smooth transfer between hydraulic input power and the mechanical output power.

FIG. 14 is a diagrammatic of one power piston and rod movement during one revolution. The centrifugal piston motor with the power cylinder disposed at a right angle to the rotational axis reveals the volumetric efficiency of the motor during operations. During the 90 degree power cycle the poser piston movement is 5.08 millimeters centrifugally. The maximum lateral travel of the rod end is 19 millimeters. These minuscule movements of the piston and rod are conducive to high output efficiency of the motor during rotational operations. FIG. 15 is a diagrammatic showing rotational axis of cylinder block 40 in relation to rotational axis of piston rod support ring 50 anchored in thrust yoke positioner assembly 60.

Cycle of Operations

The application of torque to the Output Shaft begins when pressurized hydraulic fluid is supplied to the Cylinder Block via inlet fluid ports. The cylinders and pistons are continuously rotating in the clockwise direction. The force at the pistons is transferred to the rod support ring. The rod end, anchored in the rod support ring rotates at a spherical angle in relation to the forward motion of the piston, thus allowing each piston to move forward and outward away from the axis of rotation during the 90 arc-degree power strokes. During the 90 arc-degree exhaust strokes the rod anchored end would travel, in a circular motion, back to the center returning position while exhausting fluid out via the exhaust port. This action occurs twice each revolution for each power cylinder. The application of force by the power cylinders to the rod support ring is mechanically coupled and transferred to the drive shaft to produce mechanical output torque. This cycle of operations continues during the constant input flow of pressurized hydraulic fluid.

Having fully described my invention, what I claim as new and desire to secure by Letters Patent, is:

1. An hydraulic piston motor comprising:

an annular cylinder block of rigidly fixed uniformity, having multiple cylinders secantly disposed on outer circumference of said cylinder block, means for valving hydraulic fluid into and exhausting from each individual cylinder, means for mounting the cylinder block to a drive shaft assembly, said drive shaft assembly comprising:

a single shaft and a torque actuator assembly, said torque actuator assembly comprising:

a round thrust pin with means for mounting truncated conically shaped bearing cups with needle bearings on each protruding end of said thrust pin, means for mounting the torque actuator assembly to the drive shaft assembly, means for mounting the drive shaft assembly to a housing structure, an annular piston rod support ring assembly comprising:

a rod support ring of rigidly fixed uniformity, having multiple piston and rod assemblies interiorly mounted to said rod support ring, each said piston and rod assembly comprise a piston and a rod, means for mounting the piston and rod assemblies to the rod support ring, an annular thrust yoke assembly comprising: two similar halves, each having an arcuate mortise groove, means for mounting the rod support ring assembly and said thrust yoke assembly to a thrust yoke positioner assembly, means for mounting said thrust yoke positioner assembly to said housing structure, means for universal coupling and synchronizing the rotating assemblages to produce unidirectional torque axially to the output shaft.

2. An hydraulic piston motor according to claim 1 wherein connecting the cylinder block assembly and the drive shaft assembly comprise one synchronous rotating assemblage.

3. An hydraulic piston motor according to claim 1 wherein connecting the rod support ring assembly, the thrust yoke assembly, and the thrust yoke positioner assembly, comprise one synchronous rotating assemblage.

4. An hydraulic piston motor according to claim 1 wherein a universal coupling means is provided for synchronizing said rotating assemblages to produce unidirectional torque axially to the output drive shaft.

5. An hydraulic piston motor according to claim 1 whereby applying piston power strokes circumferentially outward secantly from the rotating cylinder block to the piston rod support ring which rotates in an spherical angle, thus allowing each rod anchored end to move laterally from the centerline of said rotating cylinder block and return twice each revolution, thereby allowing said pistons to travel outward on said power stroke and return on an exhaust stroke twice per revolution.

* * * * *